US008890763B2

(12) United States Patent
Aizawa et al.

(10) Patent No.: US 8,890,763 B2
(45) Date of Patent: Nov. 18, 2014

(54) MULTIANTENNA UNIT AND COMMUNICATION APPARATUS

(75) Inventors: Daisuke Aizawa, Daito (JP); Naoyuki Wakabayashi, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 225 days.

(21) Appl. No.: 13/397,762

(22) Filed: Feb. 16, 2012

(65) Prior Publication Data

US 2012/0212389 A1 Aug. 23, 2012

(30) Foreign Application Priority Data

Feb. 21, 2011 (JP) ..... 2011-34206
Mar. 22, 2011 (JP) ..... 2011-62960

(51) Int. Cl.

| | |
|---|---|
| ***H01Q 5/01*** | (2006.01) |
| ***H01Q 1/36*** | (2006.01) |
| ***H01Q 21/28*** | (2006.01) |
| ***H01Q 1/52*** | (2006.01) |
| ***H01Q 9/42*** | (2006.01) |

(52) U.S. Cl.
CPC ..... *H01Q 21/28* (2013.01); *H01Q 1/36* (2013.01); *H01Q 1/521* (2013.01); *H01Q 9/42* (2013.01)
USPC ..... 343/853; 343/893; 343/833

(58) Field of Classification Search
CPC ..... H01Q 1/521; H01Q 21/28
USPC ..... 343/853, 893
See application file for complete search history.

(56) References Cited

U.S. PATENT DOCUMENTS

| | | | | |
|---|---|---|---|---|
| 7,352,328 | B2 | 4/2008 | Moon et al. | |
| 7,498,997 | B2 | 3/2009 | Moon et al. | |
| 7,557,761 | B2 | 7/2009 | Iwai et al. | |
| 7,636,065 | B2 | 12/2009 | Ohishi et al. | |
| 7,688,273 | B2 | 3/2010 | Montgomery et al. | |
| 7,688,275 | B2 | 3/2010 | Montgomery et al. | |
| 2006/0279465 | A1 * | 12/2006 | Moon et al. | 343/700 MS |
| 2007/0069960 | A1 * | 3/2007 | Moon et al. | 343/700 MS |
| 2008/0136736 | A1 * | 6/2008 | Proctor et al. | 343/893 |
| 2010/0265146 | A1 | 10/2010 | Montgomery et al. | |
| 2011/0021139 | A1 | 1/2011 | Montgomery et al. | |
| 2011/0080332 | A1 | 4/2011 | Montgomery et al. | |
| 2013/0016024 | A1 * | 1/2013 | Shi et al. | 343/833 |

FOREIGN PATENT DOCUMENTS

| | | | |
|---|---|---|---|
| JP | 2006-352871 | A | 12/2006 |
| JP | 2007-097167 | A | 4/2007 |
| JP | 2008-199588 | A | 8/2008 |
| JP | 2009-33548 | A | 2/2009 |
| JP | 2009-521898 | A | 6/2009 |

* cited by examiner

*Primary Examiner* — Dameon E Levi
*Assistant Examiner* — Ricardo Magallanes
(74) *Attorney, Agent, or Firm* — Crowell & Moring LLP

(57) ABSTRACT

This multiantenna unit includes a first antenna element, a second antenna element and a non-grounded passive element arranged between the first and second antenna elements. The passive element includes a first portion arranged on a front surface of a substrate and an extensional portion, connected to the first portion, extending perpendicularly to the front surface of the substrate.

12 Claims, 17 Drawing Sheets

FIRST EMBODIMENT

SECOND COMPARATIVE EXAMPLE

SECOND COMPARATIVE EXAMPLE

FIRST MODIFICATION

FIRST MODIFICATION

SECOND MODIFICATION

THIRD MODIFICATION

MULTIANTENNA UNIT AND COMMUNICATION APPARATUS

BACKGROUND OF THE INVENTION

1. Field of the Invention

The present invention relates to a multiantenna unit and a communication apparatus, and more particularly, it relates to a multiantenna unit and a communication apparatus each including a plurality of antenna elements.

2. Description of the Background Art

A multiantenna unit including a plurality of antenna elements is known in general, as disclosed in Japanese Patent Laying-Open No. 2007-97167, for example.

The aforementioned Japanese Patent Laying-Open No. 2007-97167 discloses an MIMO array antenna (multiantenna unit) including a first antenna element, a second antenna element and an isolation element (passive element) arranged between the first and second antenna elements. The isolation element has an electrical length of substantially one wavelength, and is partially grounded to a ground plane.

In the MIMO array antenna according to the aforementioned Japanese Patent Laying-Open No. 2007-97167, however, intercoupling between the first and second antenna elements can be suppressed due to the provision of the isolation element (passive element), while the isolation element must be grounded to the ground plane and hence flexibility in wiring pattern design is disadvantageously reduced. In general, a multiantenna unit is loaded on a portable apparatus, and hence further downsizing of the multiantenna unit is required.

SUMMARY OF THE INVENTION

The present invention has been proposed in order to solve the aforementioned problem, and an object of the present invention is to provide a multiantenna unit and a communication apparatus each capable of reducing intercoupling between antenna elements while suppressing reduction of flexibility in wiring pattern design and capable of allowing further downsizing.

As a result of deep studies conducted in order to attain the aforementioned object, the inventor has found that intercoupling between first and second antenna elements can be reduced while suppressing reduction of flexibility in wiring pattern design for a multiantenna unit and the multiantenna unit can be further downsized by forming a non-grounded passive element arranged between the first and second antenna elements to include a first portion arranged on a first surface and an extensional portion, connected to the first portion, extending in a direction intersecting with the first surface. The inventor has already confirmed that the intercoupling between the first and second antenna elements is reduced when the non-grounded passive element arranged between the first and second antenna elements is formed to include the first portion arranged on the first surface and the extensional portion, connected to the first portion, extending in the direction intersecting with the first surface through simulations described later.

A multiantenna unit according to a first aspect of the present invention includes a first antenna element and a second antenna element, and a non-grounded passive element arranged between the first antenna element and the second antenna element, while the passive element includes a first portion arranged on a first surface and an extensional portion, connected to the first portion, extending in a direction intersecting with the first surface.

In the multiantenna unit according to the first aspect of the present invention, as hereinabove described, the non-grounded passive element is provided between the first and second antenna elements, whereby intercoupling between the first and second antenna elements can be reduced. Further, the passive element is so rendered non-grounded that the same may not be grounded to a prescribed ground portion, whereby reduction of flexibility in wiring pattern design can be suppressed. In this multiantenna unit, therefore, the intercoupling between the first and second antenna elements can be reduced while suppressing reduction of flexibility in wiring pattern design. Further, the passive element is provided with the extensional portion extending in the direction intersecting with the first surface where the first portion is arranged so that a length necessary for the passive element can be ensured due to the extensional portion extending in the direction intersecting with the first surface also when the passive element is arranged on a small region of the first surface, whereby the region of the first surface for arranging the passive element may not be increased in size and hence the plane area of the multiantenna unit can be reduced. Consequently, the multiantenna unit can be further downsized.

In the aforementioned multiantenna unit according to the first aspect, the passive element preferably further includes a second portion, the first portion preferably includes a first opposed portion arranged to be opposed to the first antenna element, and the second portion preferably includes a second opposed portion arranged to be opposed to the second antenna element. According to this structure, the intercoupling between the first and second antenna elements can be easily reduced due to the first and second portions including the first and second opposed portions respectively.

In the aforementioned multiantenna unit according to the first aspect, the passive element preferably further includes a third portion connected to the extensional portion and arranged on a second surface at a prescribed interval from the first surface where the first portion is arranged. According to this structure, the length necessary for the passive element can be sufficiently ensured due to the third portion arranged on the second surface in addition to the extensional portion also when the passive element is arranged on a small region of the first surface, whereby the multiantenna unit can be more effectively downsized.

In this case, the multiantenna unit preferably further includes a substrate, on which the first antenna element, the second antenna element and the passive element are arranged, having at least the first surface, and the extensional portion is preferably arranged to extend in the direction intersecting with the first surface of the substrate. According to this structure, the length necessary for the passive element can be ensured due to the extensional portion extending in the direction intersecting with the first surface of the substrate also when the passive element is arranged on a small region of the first surface of the substrate, whereby the region of the first surface of the substrate for arranging the passive element may not be increased in size and hence the plane area of the multiantenna unit arranged on the substrate can be reduced. Consequently, the multiantenna unit can be downsized.

In the aforementioned multiantenna unit including the substrate, the substrate preferably has a front surface consisting of the first surface and a back surface consisting of the second surface opposite to the front surface, the first portion and the second portion are preferably arranged on the front surface of the substrate, and the third portion is preferably arranged on the back surface of the substrate. According to this structure, the passive element can be arranged over both of the front surface and the back surface of the substrate, whereby the length necessary for the passive element can be sufficiently ensured. Consequently, the multiantenna unit arranged on the substrate can be more effectively downsized.

In the aforementioned multiantenna unit having the passive element including the third portion, the first portion and the second portion arranged on the first surface are preferably arranged to overlap with the third portion arranged on the second surface in plan view. According to this structure, the plane area of the region for arranging the passive element can be reduced due to the planar overlapping of the first and second portions arranged on the first surface and the third portion arranged on the second surface, whereby the multiantenna unit can be easily downsized.

In the aforementioned multiantenna unit having the passive element including the third portion, the extensional portion preferably includes a first extensional portion connected to the first portion and a second extensional portion connected to the second portion. According to this structure, the passive element can be connected to the third portion on both of the sides of the first and second portions due to the first and second extensional portions, whereby the passive element can be connected in a well-balanced manner also in the structure having the third portion provided on the second surface.

In the aforementioned multiantenna unit according to the first aspect, the passive element preferably has an electrical length of substantially half the wavelength of electric waves output from the first antenna element and the second antenna element. According to this structure, the non-grounded passive element can be resonated.

The aforementioned multiantenna unit according to the first aspect preferably further includes a first feeding point feeding high-frequency power to the first antenna element and a second feeding point feeding high-frequency power to the second antenna element, a first matching circuit arranged between the first antenna element and the first feeding point for attaining impedance matching at a prescribed frequency of the high-frequency power, and a second matching circuit arranged between the second antenna element and the second feeding point for attaining impedance matching at a prescribed frequency of the high-frequency power. According to this structure, the intercoupling between the first and second antenna elements can be reduced and impedance matching is attained at the prescribed frequency, whereby transmission loss of energy transmitted through the first and second antenna elements can be reduced.

In the aforementioned multiantenna unit according to the first aspect, the passive element is preferably provided in a shape bent or curved on a plurality of positions in the same plane. According to this structure, the length necessary for the passive element can be easily ensured due to the bent or curved shape also when the passive element is arranged on a small region in the same plane, whereby the region for arranging the passive element may not be increased in size and hence the multiantenna unit can be further downsized.

In the aforementioned multiantenna unit according to the first aspect, the first antenna element and the second antenna element preferably include monopole antennas. According to this structure, the multiantenna unit employing the monopole antennas can be downsized by reducing intercoupling between the monopole antennas.

A communication apparatus according to a second aspect of the present invention includes a multiantenna unit, while the multiantenna unit includes a first antenna element and a second antenna element, and a non-grounded passive element arranged between the first antenna element and the second antenna element, and the passive element includes a first portion arranged on a first surface and an extensional portion, connected to the first portion, extending in a direction intersecting with the first surface.

In the communication apparatus according to the second aspect of the present invention, as hereinabove described, the non-grounded passive element is provided between the first and second antenna elements, whereby intercoupling between the first and second antenna elements can be reduced. Further, the passive element is so rendered non-grounded that the same may not be grounded to a prescribed ground portion, whereby reduction of flexibility in wiring pattern design can be suppressed. In this communication apparatus, therefore, the intercoupling between the first and second antenna elements can be reduced while suppressing reduction of flexibility in wiring pattern design. Further, the passive element is provided with the extensional portion extending in the direction intersecting with the first surface where the first portion is arranged so that a length necessary for the passive element can be ensured due to the extensional portion extending in the direction intersecting with the first surface also when the passive element is arranged on a small region of the first surface, whereby the region of the first surface for arranging the passive element may not be increased in size and hence the plane area of the multiantenna unit can be reduced. Such effects are particularly effective in a portable communication apparatus to which downsizing is expected.

As a result of deep studies conducted in order to attain the aforementioned object, the inventor has found that intercoupling between first and second antenna elements can be reduced and a multiantenna unit can be further downsized while suppressing reduction of flexibility in wiring pattern design by arranging a non-grounded passive element including first and second coupling portions coupled to the first and second antenna elements respectively and a connecting portion connecting the first and second coupling portions with each other between the first and second antenna elements and at least partially providing the passive element in a bent or curved shape. The inventor has already confirmed that the intercoupling between the first and second antenna elements is reduced when the non-grounded passive element including the first and second coupling portions and the connecting portion is arranged between the first and second antenna elements and at least partially provided in the bent or curved shape through simulations described later.

A multiantenna unit according to a third aspect of the present invention includes a first antenna element and a second antenna element, and a non-grounded passive element arranged between the first antenna element and the second antenna element, while the passive element includes a first coupling portion coupled to the first antenna element, a second coupling portion coupled to the second antenna element and a connecting portion connecting the first coupling portion and the second coupling portion with each other, and is at least partially provided in a bent or curved shape.

In the aforementioned multiantenna unit according to the third aspect, the non-grounded passive element including the first and second coupling portions coupled to the first and second antenna elements respectively and the connecting portion connecting the first and second coupling portions with each other is arranged between the first and second antenna elements, whereby intercoupling between the first and second coupling portions can be reduced. Further, the passive element is so rendered non-grounded that the same may not be grounded to a prescribed ground plane, whereby reduction of flexibility in wiring pattern design can be suppressed. In this multiantenna unit, therefore, the intercoupling between the first and second antenna elements can be reduced while suppressing reduction of flexibility in wiring pattern design. Further, the intercoupling between the first and second antenna elements can be so reduced that the distance therebetween may not be increased in order to reduce the intercoupling between the first and second antenna elements, whereby the multiantenna unit can be downsized. In addition, the passive element is at least partially provided in the bent or curved shape so that a length necessary for the passive element can be ensured due to the bent or curved shape in a limited space between the first and second antenna elements, whereby the space for arranging the passive element may not be increased in size and hence the multiantenna unit can be further downsized.

In the aforementioned multiantenna unit according to the third aspect, the connecting portion of the passive element is preferably provided in the bent or curved shape. According to this structure, the length necessary for the passive element can be easily ensured due to the bent or curved shape of the connecting portion connecting the first and second coupling portions with each other, whereby increase in the size of the space for arranging the passive element can be suppressed.

In the aforementioned multiantenna unit according to the third aspect, the passive element preferably has an electrical length of substantially half the wavelength $\lambda$ of electric waves output from the first antenna element and the second antenna element. According to this structure, the non-grounded passive element can be resonated.

The aforementioned multiantenna unit according to the third aspect preferably further includes a first feeding point feeding high-frequency power to the first antenna element and a second feeding point feeding high-frequency power to the second antenna element, a first matching circuit arranged between the first antenna element and the first feeding point for attaining impedance matching at a prescribed frequency of the high-frequency power, and a second matching circuit arranged between the second antenna element and the second feeding point for attaining impedance matching at a prescribed frequency of the high-frequency power. According to this structure, the intercoupling between the first and second antenna elements can be reduced and impedance matching is attained at the prescribed frequency, whereby transmission loss of energy transmitted through the first and second antenna elements can be reduced.

In the aforementioned multiantenna unit according to the third aspect, the first antenna element and the second antenna element preferably include monopole antennas. According to this structure, the multiantenna unit employing the monopole antennas can be downsized by reducing intercoupling between the monopole antennas.

A communication apparatus according to a fourth aspect of the present invention includes a multiantenna unit, while the multiantenna unit includes a first antenna element and a second antenna element, and a non-grounded passive element arranged between the first antenna element and the second antenna element, and the passive element includes a first coupling portion coupled to the first antenna element, a second coupling portion coupled to the second antenna element and a connecting portion connecting the first coupling portion and the second coupling portion with each other, and is at least partially provided in a bent or curved shape.

In the communication apparatus according to the fourth aspect of the present invention, as hereinabove described, the non-grounded passive element having the first and second coupling portions coupled to the first and second antenna elements respectively and the connecting portion connecting the first and second coupling portions with each other is arranged between the first and second antenna elements, whereby intercoupling between the first and second antenna elements can be reduced. Further, the passive element is so rendered non-grounded that the same may not be grounded to a prescribed ground plane, whereby reduction of flexibility in wiring pattern design can be suppressed. In this communication apparatus, therefore, the intercoupling between the first and second antenna elements can be reduced while suppressing reduction of flexibility in wiring pattern design. Further, the intercoupling between the first and second antenna elements can be so reduced that the distance therebetween may not be increased in order to reduce the intercoupling between the first and second antenna elements, whereby the multiantenna unit can be downsized. In addition, the passive element is at least partially provided in the bent or curved shape so that a length necessary for the passive element can be ensured due to the bent or curved shape in a limited space between the first and second antenna elements, whereby the space for arranging the passive element may not be increased in size and hence the multiantenna unit can be further downsized. Consequently, the communication apparatus including such a multiantenna unit itself can also be downsized. The present invention is particularly effective in a communication apparatus such as a portable telephone to which downsizing is expected.

In the aforementioned communication apparatus according to the fourth aspect, the connecting portion of the passive element of the multiantenna unit is preferably provided in the bent or curved shape. According to this structure, the length necessary for the passive element can be easily ensured due to the bent or curved shape of the connecting portion connecting the first and second coupling portions with each other, whereby increase in the size of the space for arranging the passive element can be suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

(First Embodiment)

First, the structure of a portable apparatus 100 according to a first embodiment of the present invention is described with reference to FIGS. 1 to 4. The portable apparatus 100 is an example of the "communication apparatus" in the present invention.

Figure 1:
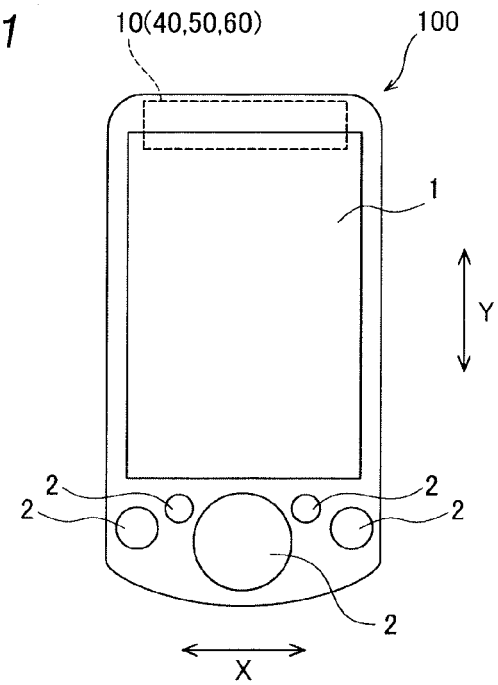
FIG. 1 is a plan view showing the overall structure of a portable apparatus according to each of first to third embodiments of the present invention.

The portable apparatus 100 according to the first embodiment of the present invention has a substantially rectangular shape in front elevational view, as shown in FIG. 1. The portable apparatus 100 includes a display screen portion 1 and operation portions 2 consisting of buttons. A multiantenna unit 10 is provided n a housing of the portable apparatus 100.

The multiantenna unit 10 is structured for MIMO (Multiple-Input Multiple-Output) communication allowing multiple inputs/outputs at a prescribed frequency with a plurality of antenna elements.

Figure 2:
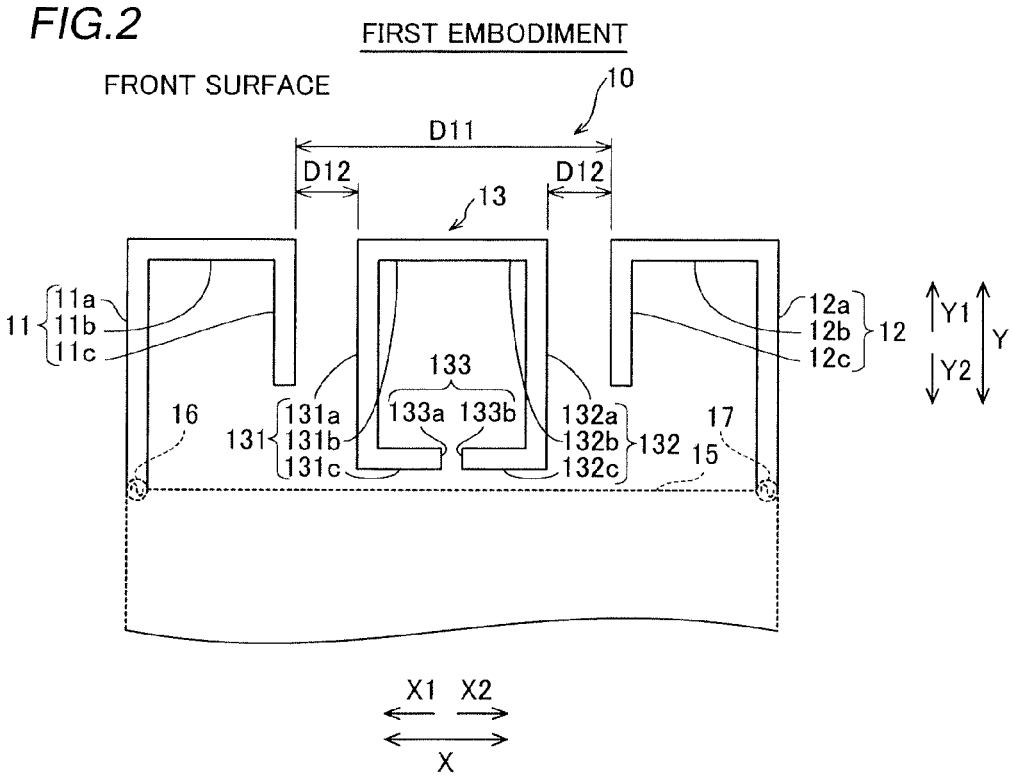
FIG. 2 is a plan view showing a front surface of a multiantenna unit of the portable apparatus according to the first embodiment of the present invention.
Figure 3:
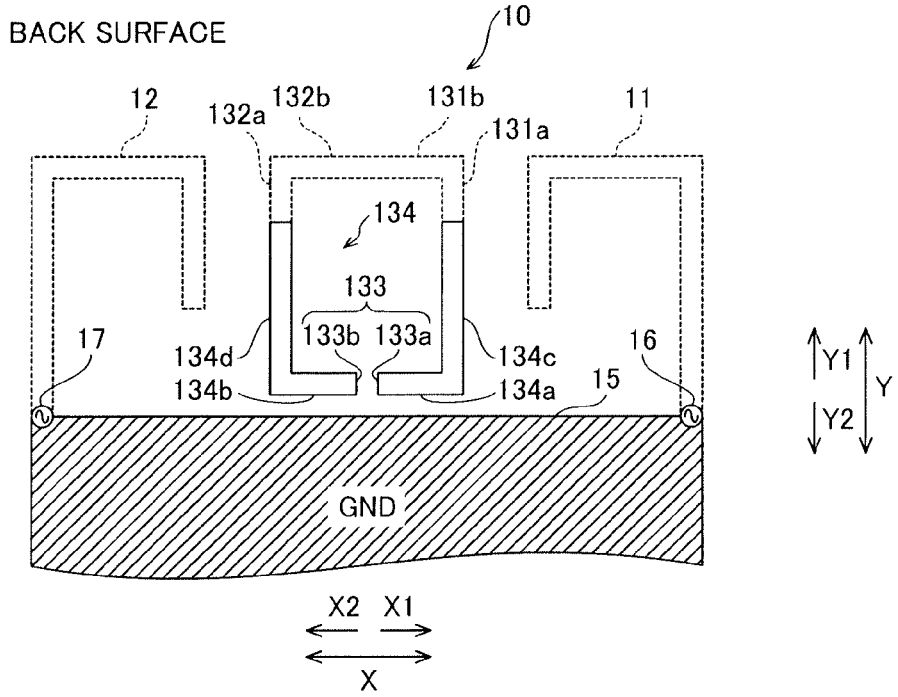
FIG. 3 is a plan view showing a back surface of the multiantenna unit of the portable apparatus according to the first embodiment of the present invention.

The multiantenna unit 10 includes a first antenna element 11 and a second antenna element 12, a passive element 13 arranged between the first and second antenna elements 11 and 12, a substrate 14 (see FIG. 4) on which the first antenna element 11, the second antenna element 12 and the passive element 13 are arranged, a ground portion 15, a first feeding point 16 for feeding high-frequency power to the first antenna element 11 and a second feeding point 17 for feeding high-frequency power to the second antenna element 12, as shown in FIGS. 2 and 3.

The first antenna element 11 is arranged on a side of the passive element 13 along arrow X1, while the second antenna element 12 is arranged on another side of the passive element 13 along arrow X2. The first antenna element 11 (second antenna element 12) is in the form of a thin plate, and provided on a front surface 14*a* of the substrate 14 described later. The first antenna element 11 (second antenna element 12) is a monopole antenna having an electrical length of substantially quarter a wavelength (120 mm) of 2.5 GHz corresponding to the multiantenna unit 10. More specifically, the first antenna element 11 (second antenna element 12) is substantially inversely U-shaped. The first antenna element 11 (second antenna element 12) includes a first feeding point connecting portion 11*a* (second feeding point connecting portion 12*a*), a first lateral portion 11*b* (second lateral portion 12*b*) and a third opposed portion 11*c* (fourth opposed portion 12*c*). The first antenna element 11 (second antenna element 12) is so formed that an end portion along arrow Y2 is connected to a first feeding point 16 (second feeding point 17) provided on the ground portion 15 of a back surface 14*b* of the substrate 14 described later to extend along arrow Y1. The first lateral portion 11*b* (second lateral portion 12*b*) is formed to be connected to an end portion of the first feeding point connecting portion 11*a* (second feeding point connecting portion 12*a*) along arrow Y1 and to extend along arrow X2 (along arrow X1). The third opposed portion 11*c* (fourth opposed portion 12*c*) is formed to be connected to an end portion of the first lateral portion 11*b* (second lateral portion 12*b*) along arrow X2 (along arrow X1) and to extend along arrow Y2. The electrical length denotes a length with reference to one wavelength of a signal proceeding on a conductor constituting an antenna.

According to the first embodiment, the passive element 13 includes a first portion 131, a second portion 132, an extensional portion 133 and a third portion 134. The first portion 131 (second portion 132) is arranged on the front surface 14*a* of the substrate 14. The first portion 131 (second portion 132) includes a first opposed portion 131*a* (second opposed portion 132*a*), a third lateral portion 131*b* (fourth lateral portion 132*b*) and a fifth lateral portion 131*c* (sixth lateral portion 132*c*). The first opposed portion 131*a* (second opposed portion 132*a*) is arranged to be opposed to the third opposed portion 11*c* of the first antenna element 11 (fourth opposed portion 12*c* of the second antenna element 12). The third lateral portion 131*b* (fourth lateral portion 132*b*) is formed to be connected to an end portion of the first opposed portion 131*a* (second opposed portion 132*a*) along arrow Y1 and to extend along arrow X2 (along arrow X1). The fifth lateral portion 131*c* (sixth lateral portion 132*c*) is formed to be connected to an end portion of the first opposed portion 131*a* (second opposed portion 132*a*) along arrow Y2 and to extend along arrow X2 (along arrow X1). The first portion 131 and the second portion 132 are connected with each other by the third lateral portion 131*b* and the fourth lateral portion 132*b*.

The extensional portion 133 includes a first extensional portion 133*a* and a second extensional portion 133*b*. The first extensional portion 133*a* (second extensional portion 133*b*) is connected to an end portion of the fifth lateral portion 131*c* of the first portion 131 (sixth lateral portion 132*c* of the second portion 132) along arrow X2 (along arrow X1), and arranged to extend in a direction perpendicular to the front surface 14*a* of the substrate 14 (in the thickness direction (along arrow Z2) of the substrate 14). The third portion 134 is arranged on the back surface 14*b* of the substrate 14. The third portion 134 includes a seventh lateral portion 134*a* (eighth lateral portion 134*b*) connected to the first extensional portion 133*a* (second extensional portion 133*b*) to extend along arrow X1 (along arrow X2) and a first vertical portion 134*c* (second vertical portion 134*d*) connected to an end portion of the seventh lateral portion 134*a* (eighth lateral portion 134*b*) along arrow X1 (along arrow X2) to extend along arrow Y1. The passive element 13 is formed to be in a non-grounded state not grounded to the ground portion 15. This passive element 13 has an electrical length of substantially half the wavelength of 2.5 GHz corresponding to the multiantenna unit 10. Further, the passive element 13 is formed to be resonated due to currents flowing in the first and second antenna elements 11 and 12.

The first opposed portion 131*a* and the second opposed portion 132*a* are formed to extend in a direction Y, and arranged substantially parallelly to each other. The first opposed portion 131*a* is arranged at a distance allowing electromagnetic field coupling from the first antenna element 11. The second opposed portion 132*a* is arranged at a distance allowing electromagnetic field coupling from the second antenna element 12.

Figure 4:
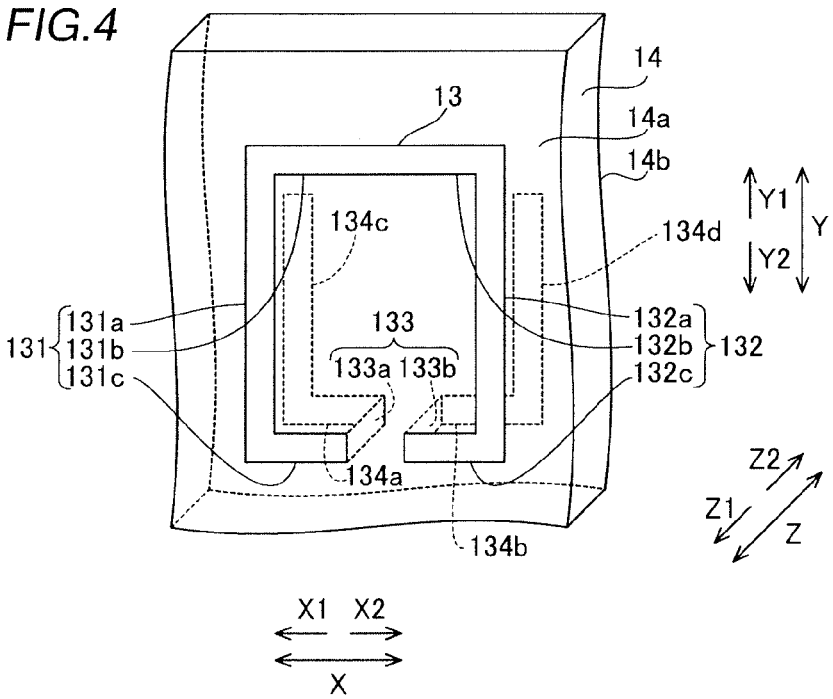
FIG. 4 is a perspective view showing a passive element of the multiantenna unit of the portable apparatus according to the first embodiment of the present invention.

As shown in FIG. 4, the substrate 14 has the front surface 14*a* arranged along arrow Z1 and the back surface 14*b* arranged along arrow Z2 at a prescribed interval from the front surface 14*a*, while the first portion 131 and the second portion 132 of the passive element 13 are arranged on the front surface 14*a* of the substrate 14. The third portion 134 of the passive element 13 is arranged on the back surface 14*b* of the substrate 14. The ground portion 15 is also arranged on the back surface 14*b* of the substrate 14. The first portion 131 and the second portion 132 are arranged on the front surface 14*a* of the substrate 14 to overlap with the third portion 134 arranged on the back surface 14*b* of the substrate 14 in plan view (as viewed from a direction Z). More specifically, part of the first opposed portion 131*a* of the first portion 131 (second opposed portion 132*a* of the second portion 132) and the first vertical portion 134*c* (second vertical portion 134*d*) of the third portion 134 are arranged to overlap with each other in plan view. Further, the fifth lateral portion 131*c* of the first portion 131 (sixth lateral portion 132*c* of the second portion 132) and the seventh lateral portion 134*a* (eighth lateral portion 134*b*) of the third portion 134 are arranged to overlap with each other in plan view (as viewed from the direction Z). Each of the first portion 131 and the second portion 132 arranged on the front surface 14*a* of the substrate 14 is provided in a shape bent on a plurality of positions. The third portion 134 arranged on the back surface 14*b* of the substrate 14 is also provided in a shape bent on a plurality of positions. The front surface 14*a* and the back surface 14*b* are examples of the "first surface" and the "second surface" in the present invention.

The first feeding point 16 (second feeding point 17) is arranged on the ground portion 15 provided on the back surface 14*b* of the substrate 14. The first feeding point 16 (second feeding point 17) is connected to an end portion of the first antenna element 11 (second antenna element 12) along arrow Y2. The first feeding point 16 (second feeding point 17) connects the first antenna element 11 (second antenna element 12) with a feeder (not shown).

According to the first embodiment, as hereinabove described, the non-grounded passive element 13 is provided between the first and second antenna elements 11 and 12, whereby intercoupling between the first and second antenna elements 11 and 12 can be reduced. Further, the passive element 13 is so rendered non-grounded that the same may not be grounded to the prescribed ground portion 15, whereby reduction of flexibility in wiring pattern design can be suppressed. In the multiantenna unit 10, therefore, the intercoupling between the first and second antenna elements 11 and 12 can be reduced while suppressing reduction of flexibility in wiring pattern design. Further, the passive element 13 is provided with the extensional portion 133 (first and second extensional portions 133*a* and 133*b*) extending perpendicularly to the front surface 14*a* of the substrate 14 on which the first portion 131 and the second portion 132 are arranged so that a length necessary for the passive element 13 can be ensured due to the extensional portion 133 extending perpendicularly to the front surface 14*a* of the substrate 14 also when the passive element 13 is arranged on a small region of the front surface 14*a* of the substrate 14, whereby the region of the front surface 14*a* of the substrate 14 for arranging the passive element 13 may not be increased in size and hence the plane area of the multiantenna unit 10 can be reduced. Such an effect is particularly effective in the portable apparatus 100 to which downsizing is expected.

As hereinabove described, the inventor has found that the intercoupling between the first and second antenna elements 11 and 12 can be reduced while suppressing reduction of flexibility in wiring pattern design and the multiantenna unit 10 can be further downsized by forming the non-grounded passive element 13 arranged between the first and second antenna elements 11 and 12 to include the first portion 131 including the first opposed portion 131*a* arranged to be opposed to the first antenna element 11, the second portion 132 including the second opposed portion 132*a* arranged to be opposed to the second antenna element 12 and the extensional portion 133, connected to the first portion 131 and the second portion 132, extending perpendicularly to the front surface 14*a* of the substrate 14 on which the first portion 131 and the second portion 132 are arranged.

According to the first embodiment, the passive element 13 is formed to include the third portion 134 connected to the extensional portion 133 and arranged on the back surface 14*b* of the substrate 14 at the prescribed interval from the front surface 14*a* where the first portion 131 and the second portion 132 are arranged so that the length necessary for the passive element 13 can be sufficiently ensured due to the third portion 134 arranged on the back surface 14*b* of the substrate 14 in addition to the extensional portion 133 also when the passive element 13 is arranged on the small region of the front surface 14*a* of the substrate 14, whereby the multiantenna unit 10 can be more effectively downsized.

According to the first embodiment, the multiantenna unit 10 is provided with the substrate 14 having the front surface 14*a* where the first antenna element 11, the second antenna element 12 and the passive element 13 are arranged and the extensional portion 133 is arranged to extend in a direction intersecting with the front surface 14*a* of the substrate 14 so that the length necessary for the passive element 13 can be ensured due to the extensional portion 133 extending in the direction intersecting with the front surface 14*a* of the substrate 14 also when the passive element 13 is arranged on the small region of the front surface 14*a* of the substrate 14, whereby the region of the front surface 14*a* of the substrate 14 for arranging the passive element 13 may not be increased in size and hence the plane area of the multiantenna unit 10 arranged on the substrate 14 can be reduced. Consequently, the multiantenna unit 10 can be downsized.

According to the first embodiment, the substrate 14 has the front surface 14*a* and the back surface 14*b* opposite to the front surface 14*a*, and the first portion 131 and the second portion 132 are arranged on the front surface 14*a* of the substrate 14 while the third portion 134 is arranged on the back surface 14*b* of the substrate 14 so that the passive element 13 can be arranged over both of the front surface 14*a* and the back surface 14*b* of the substrate 14, whereby the length necessary for the passive element 13 can be sufficiently ensured. Consequently, the multiantenna unit 10 arranged on the substrate 14 can be more effectively downsized.

According to the first embodiment, the first portion 131 and the second portion 132 are arranged on the front surface 14*a* of the substrate 14 to overlap with the third portion 134 arranged on the back surface 14*b* of the substrate 14 in plan view so that the plane area of the region for arranging the passive element 13 can be reduced due to the planar overlapping of the first portion 131 and the second portion 132 arranged on the front surface 14*a* of the substrate 14 and the third portion 134 arranged on the back surface 14*b* of the substrate 14, whereby the multiantenna unit 10 can be easily downsized.

According to the first embodiment, the extensional portion 133 is formed to include the first extensional portion 133*a* connected to the first portion 131 and the second extensional portion 133*b* connected to the second portion 132, whereby the passive element 13 can be connected to the third portion 134 in a well-balanced manner on both of the sides of the first portion 131 and the second portion 132 due to the first extensional portion 133*a* and the second extensional portion 133*b*.

According to the first embodiment, the passive element 13 has the electrical length of substantially half the wavelength of electric waves output from the first and second antenna elements 11 and 12. According to this structure, the non-grounded passive element 13 can be resonated.

According to the first embodiment, the passive element 13 is provided in a shape bent on a plurality of positions in the same plane. Consequently, the region for arranging the passive element 13 can be reduced in size, whereby the multiantenna unit 10 can be more downsized.

Results of a simulation conducted in order to confirm effects of the aforementioned first embodiment are now described. In this simulation, a multiantenna unit 10 corresponding to the first embodiment shown in FIGS. 2 and 3 was compared with a multiantenna unit 20 according to first comparative example shown in FIGS. 6 and 7 and a multiantenna unit 30 according to second comparative example shown in FIGS. 9 and 10.

In the multiantenna unit 10 corresponding to the first embodiment, first and second antenna elements 11 and 12 were so arranged that a third opposed portion 11*c* and a fourth opposed portion 12*c* were separated from each other by a distance D11 of 15 mm, as shown in FIGS. 2 and 3. Further, a passive element 13 was so arranged that a third opposed portion 11*c* (fourth opposed portion 12*c*) and a first opposed portion 131*a* (second opposed portion 132*a*) were separated from each other by a distance D12 of 3 mm. An extensional portion 133 (first and second extensional portions 133*a* and 133*b*) has a length of 1 mm, which is substantially equal to the thickness of a substrate 14. The first antenna element 11, the second antenna element 12 and the passive element 13 of the multiantenna unit 10 are arranged in a rectangular region of 31 mm and 12 mm in directions X and Y.

Figure 6:
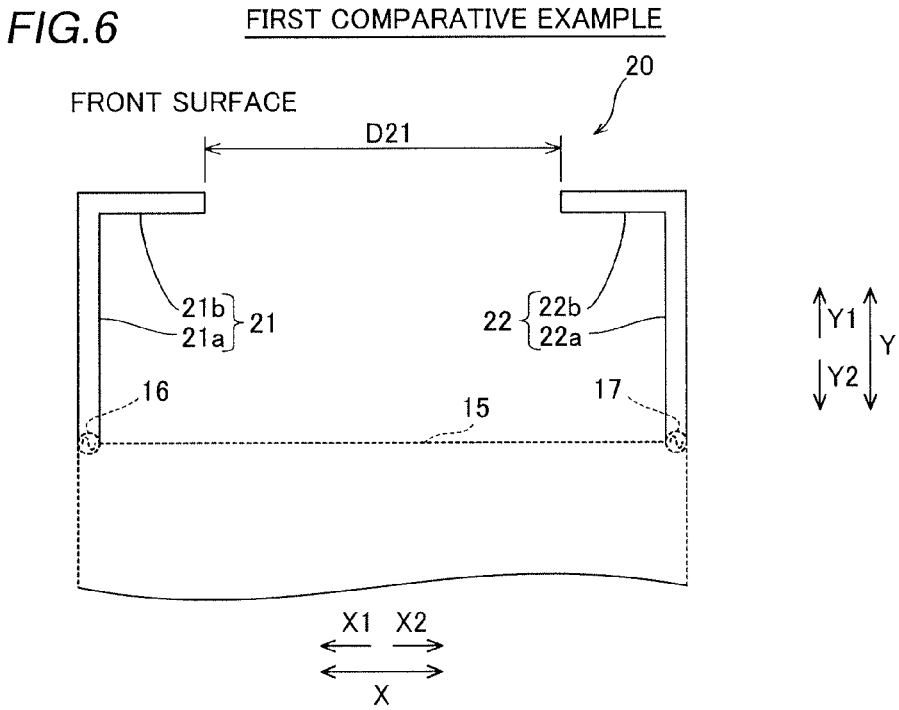
FIG. 6 is a plan view showing a front surface of a multiantenna unit according to first comparative example.
Figure 7:
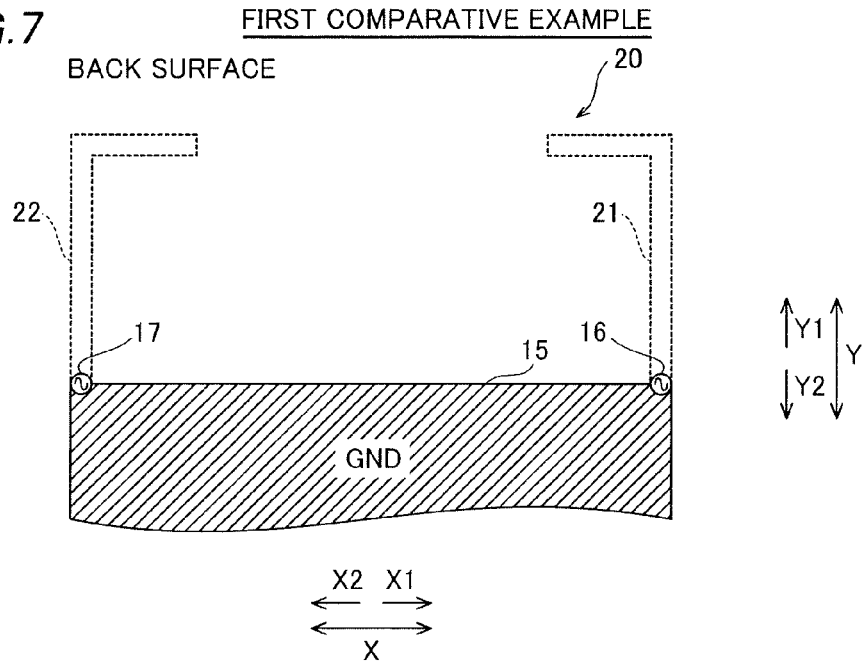
FIG. 7 is a plan view showing a back surface of the multiantenna unit according to first comparative example.

In the multiantenna unit 20 according to first comparative example, no passive element was provided between two antenna elements 21 and 22 as shown in FIGS. 6 and 7, dissimilarly to the multiantenna unit 10, corresponding to the first embodiment, provided with the passive element 13. The antenna element 21 (22) is arranged on a front surface 14*a* of a substrate 14. This antenna element 21 (22) includes a feeding point connecting portion 21*a* (22*a*) whose end portion along arrow Y2 is connected to a feeding point 16 (17) provided on a ground portion 15 arranged on a back surface 14*b* of the substrate 14 to extend along arrow Y1 and a lateral portion 21*b* (22*b*) connected to an end portion of the feeding point connecting portion 21*a* (22*a*) along arrow Y1 to extend along arrow X2 (along arrow X1). In the multiantenna unit 20 according to first comparative example, the antenna elements 21 and 22 were so arranged that the lateral portions 21*b* and 22*b* were separated from each other by a distance D21 of 17 mm. The antenna elements 21 and 22 of the multiantenna unit 20 are arranged in a rectangular region of 29 mm and 12 mm along directions X and Y. The remaining structure of the multiantenna unit 20 according to first comparative example is similar to that of the multiantenna unit 10 corresponding to the aforementioned first embodiment.

Figure 9:
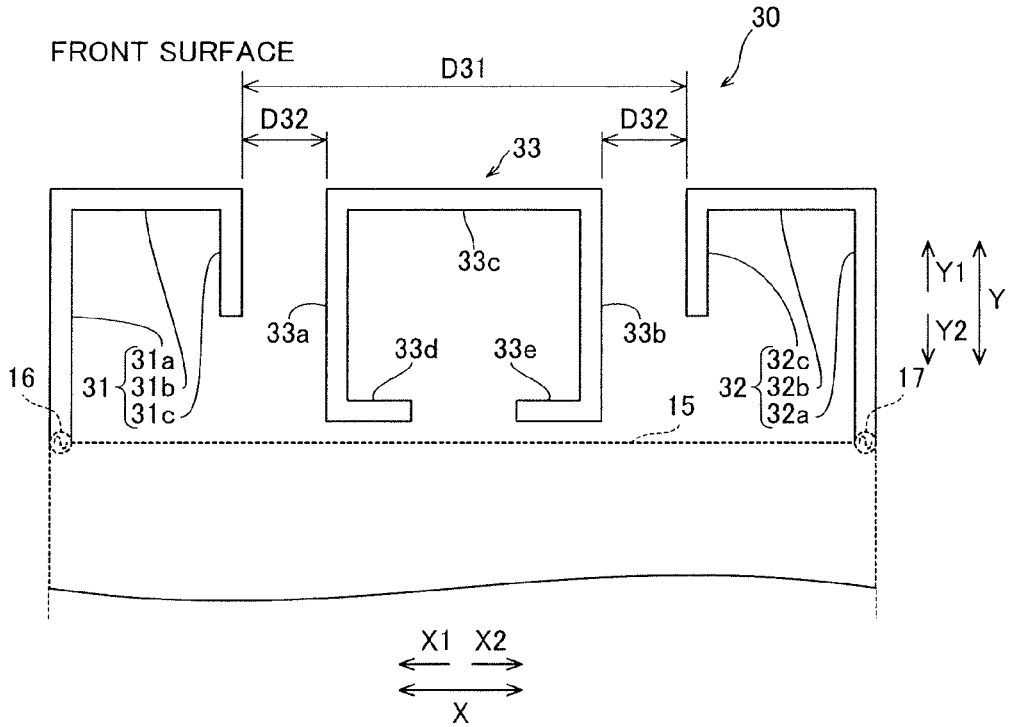
FIG. 9 is a plan view showing a front surface of a multiantenna unit according to second comparative example.
Figure 10:
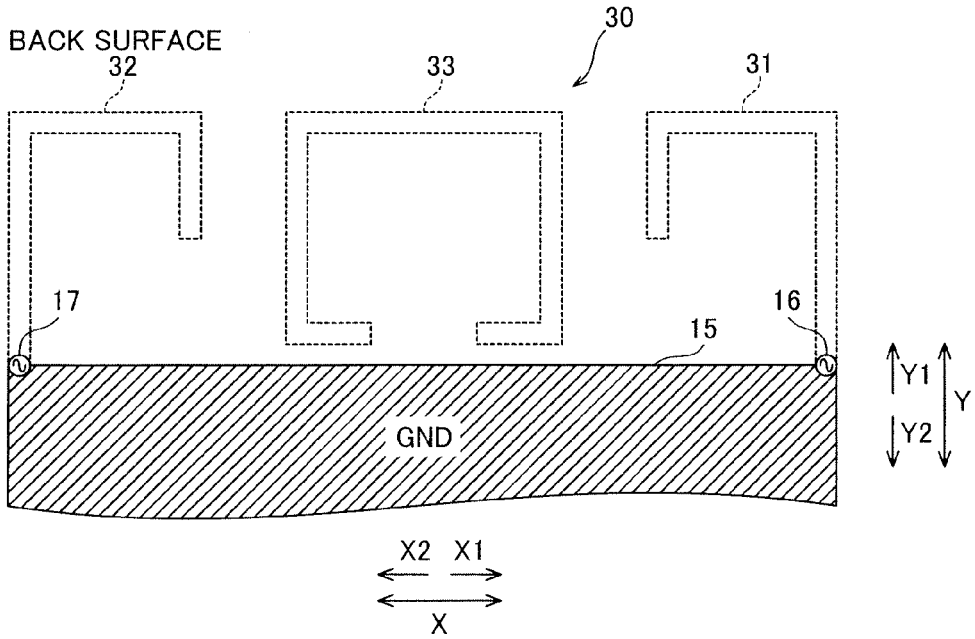
FIG. 10 is a plan view showing a back surface of the multiantenna unit according to second comparative example.

In the multiantenna unit 30 according to second comparative example, a passive element 33 was arranged only on a front surface 14*a* of a substrate 14 as shown in FIGS. 9 and 10, dissimilarly to the multiantenna unit 10, corresponding to the first embodiment, having the passive element 13 arranged on the front surface 14*a* of the substrate 14, a portion of the substrate 14 extending in the thickness direction and the back surface 14*b* of the substrate 14. An antenna element 31 (32) is arranged on the front surface 14*a* of the substrate 14. The antenna element 31 (32) includes a feeding point connecting portion 31*a* (32*a*), a lateral portion 31*b* (32*b*) and an opposed portion 31*c* (32*c*). The feeding point connecting portion 31*a* (32*a*) is so formed that an end portion along arrow Y2 is connected to a feeding point 16 (17) provided on a ground portion 15 arranged on a back surface 14*b* of the substrate 14 to extend along arrow Y1. The lateral portion 31*b* (32*b*) is formed to be connected to an end portion of the feeding point connecting portion 31*a* (32*a*) along arrow Y1 and to extend along arrow X2 (along arrow X1). The opposed portion 31*c* (32*c*) is formed to be connected to an end portion of the lateral portion 31*b* (32*b*) along arrow X2 (along arrow X1) and to extend along arrow Y2. The passive element 33 is arranged on the front surface 14*a* of the substrate 14. The passive element 33 includes an opposed portion 33*a* (33*b*) arranged to be opposed to the opposed portion 31*c* (32*c*), a lateral portion 33*c* connecting end portions of the opposed portions 33*a* and 33*b* along arrow Y1 with each other and a lateral portion 33*d* (33*e*) connected to an end portion of the opposed portion 33*a* (33*b*) along arrow Y2 to extend along arrow X2 (along arrow X1).

In the multiantenna unit 30 according to second comparative example, antenna elements 31 and 32 were so arranged that the opposed portions 31*c* and 32*c* were separated from each other by a distance D31 of 21 mm. Further, the passive element 33 was so arranged that the opposed portions 31*c* (32*c*) and 33*a* (33*b*) were separated from each other by a distance D32 of 4 mm. The antenna elements 31 and 32 and the passive element 33 of the multiantenna unit 30 are arranged in a rectangular region of 39 mm and 12 mm in directions X and Y. In the multiantenna unit 30 according to second comparative example, the passive element 33 is arranged only on the front surface 14*a* of the substrate 14, and hence the plane area of the region for arranging the antenna elements 31 and 32 and the passive element 33 is larger than that in the multiantenna unit 10 corresponding to the first embodiment. The remaining structure of the multiantenna unit 30 according to second comparative example is similar to that of the multiantenna unit 10 corresponding to the aforementioned first embodiment.

Figure 5:
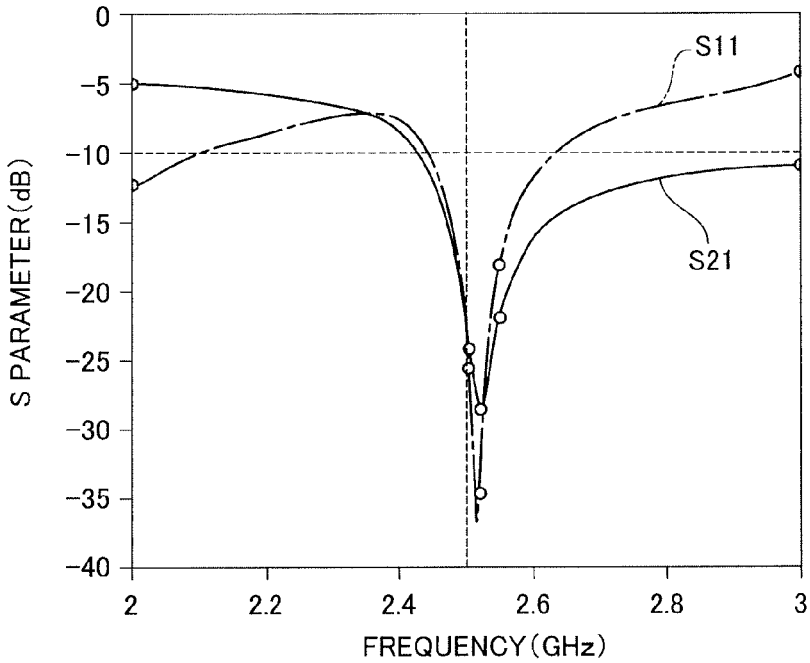
FIG. 5 illustrates the characteristics of S parameters in a simulation of a multiantenna unit corresponding to the first embodiment of the present invention.
Figure 8:
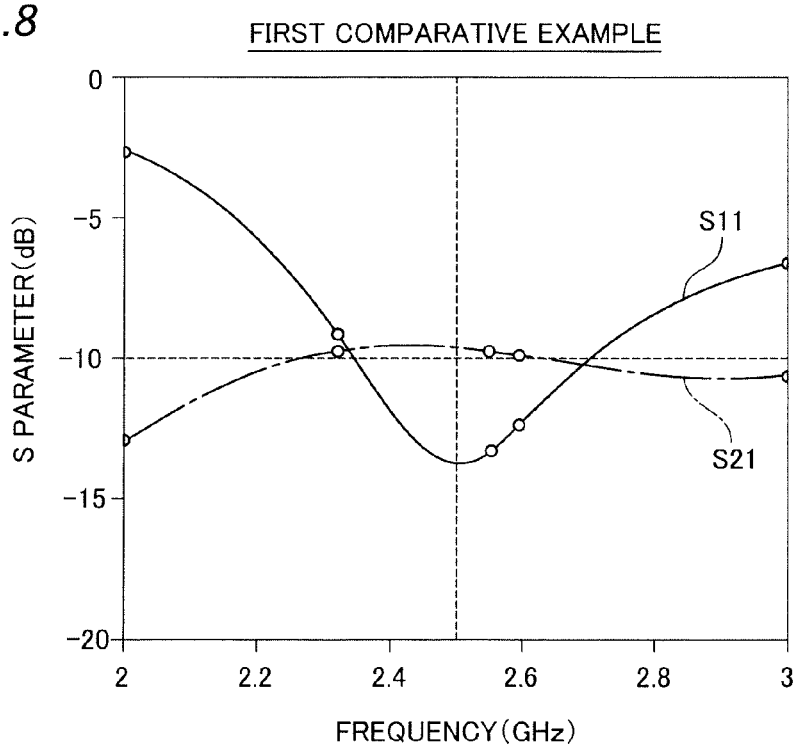
FIG. 8 illustrates the characteristics of S parameters in a simulation of the multiantenna unit according to first comparative example shown in FIGS. 6 and 7.
Figure 11:
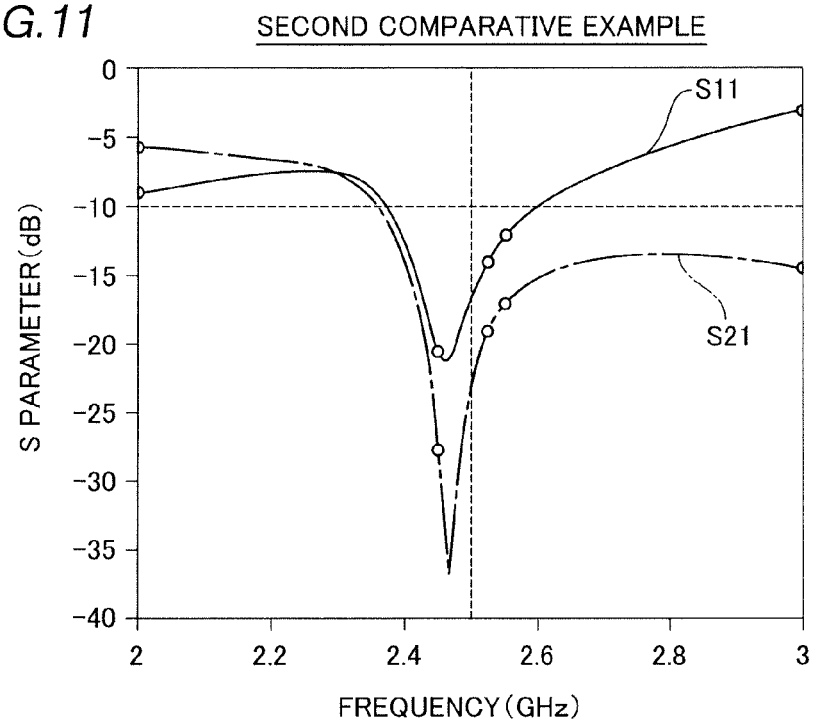
FIG. 11 illustrates the characteristics of S parameters in a simulation of the multiantenna unit according to second comparative example shown in FIGS. 9 and 10.

The characteristics of S parameters of the multiantenna unit 10 corresponding to the first embodiment and the multiantenna units 20 and 30 according to first and second comparative examples are now described with reference to FIGS. 5, 8 and 11. In the S parameters shown in FIGS. 5, 8 and 11, parameters S11 indicate magnitudes of reflection coefficients of the antenna elements 11 and 12, 21 and 22 and 31 and 33, and parameters S21 indicate magnitudes of intercoupling between the pairs of antenna elements 11 and 12, 21 and 22 and 31 and 33. Referring to FIGS. 5, 8 and 11, the axes of ordinates show frequencies, and the axes of abscissas show the magnitudes (unit: dB) of the parameters S11 and S21.

In the multiantenna unit 10 corresponding to the first embodiment, the parameters S11 and S21 were about −25 dB and about −24 dB respectively at the frequency of 2.5 GHz corresponding to the multiantenna unit 10, as shown in FIG. 5. In the multiantenna unit 20 according to first comparative example, on the other hand, the parameters S11 and S21 were about −13 dB and about −9.6 dB respectively at the frequency of 2.5 GHz, as shown in FIG. 8. In the multiantenna unit 30 according to second comparative example, the parameters S11 and S21 were about −16 dB and about −23 dB respectively at the frequency of 2.5 GHz, as shown in FIG. 11.

Consequently, the multiantenna unit 10 corresponding to the first embodiment has the parameter S21 smaller than that of the multiantenna unit 20 according to first comparative example, and hence it has been proved that the intercoupling between the first and second antenna elements 11 and 12 can be reduced by providing the non-grounded passive element 13. If the parameter S21 is not more than −10 dB, intercoupling between the first and second antenna elements 11 and 12 is conceivably small.

This is conceivably for the following reason: In the multiantenna unit 10 corresponding to the first embodiment, direct coupling resulting from a current flowing in either the first antenna element 11 or the second antenna element 12 and indirect coupling resulting from a current flowing in the passive element 13 are conceivably caused in the first and second antenna elements 11 and 12, to reduce the intercoupling between the first and second antenna elements 11 and 12.

In the multiantenna unit 30 according to second comparative example and the multiantenna unit 10 corresponding to the first embodiment, the parameters S21 indicating the magnitudes of the intercoupling between the pairs of antenna elements 31 and 32 and 11 and 12 were substantially identical to each other. Therefore, it has been proved that the intercoupling between the first and second antenna elements 11 and 12 can be reduced also when the passive element 13 is arranged on the front surface 14*a* of the substrate 14, the portion of the substrate 14 in the thickness direction and the back surface 14*b* of the substrate 14 to reduce the size of the region for arranging the multiantenna unit 10.

(Second Embodiment)

A multiantenna unit 40 of a portable apparatus 100 according to a second embodiment of the present invention is now described with reference to FIGS. 12 and 13. In the multiantenna unit 40 according to the second embodiment, each of a first feeding point connecting portion 41*a* of a first antenna element 41 and a second feeding point connecting portion 42*a* of a second antenna element 42 is provided in a shape bent on a plurality of positions, dissimilarly to the aforementioned first embodiment.

Figure 12:
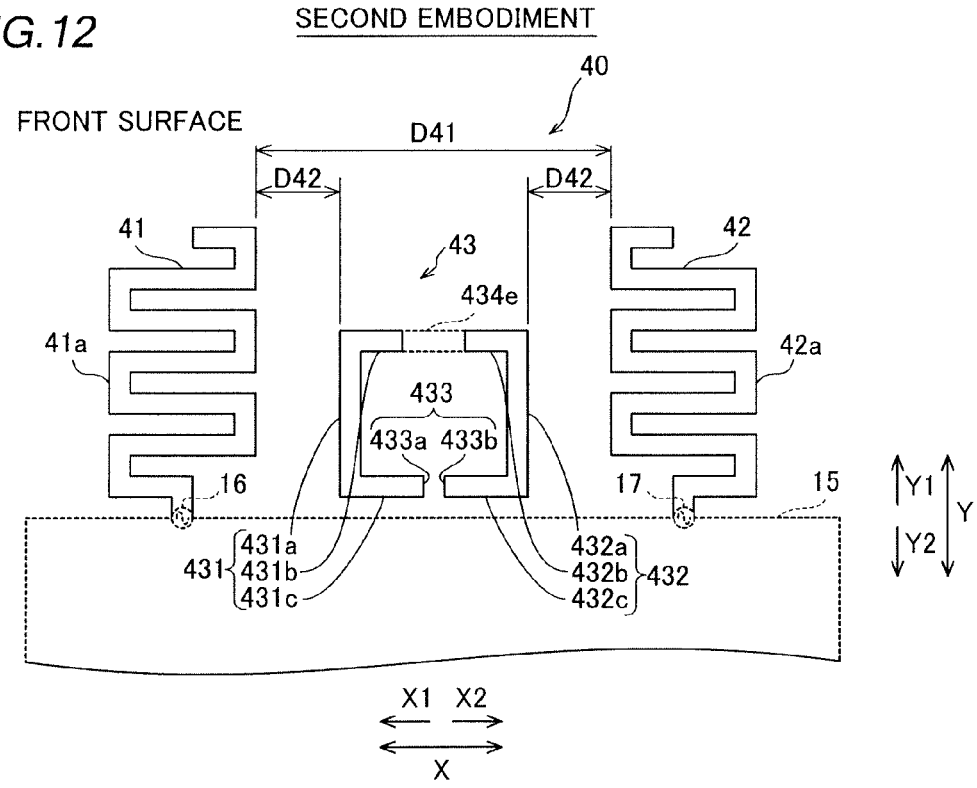
FIG. 12 is a plan view showing a front surface of a multiantenna unit of the portable apparatus according to the second embodiment of the present invention.
Figure 13:
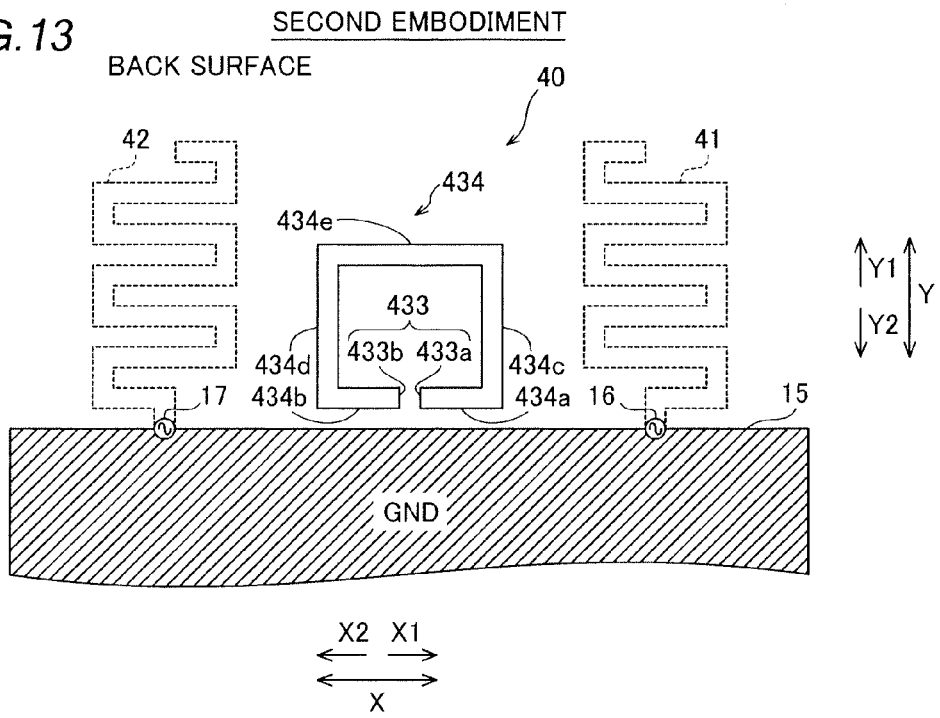
FIG. 13 is a plan view showing a back surface of the multiantenna unit of the portable apparatus according to the second embodiment of the present invention.

The multiantenna unit 40 of the portable apparatus 100 according to the second embodiment includes the first and second antenna elements 41 and 42, a passive element 43 arranged between the first and second antenna elements 41 and 42, a substrate 14 (see FIG. 4), a ground portion 15, a first feeding point 16 for feeding high-frequency power to the first antenna element 41 and a second feeding point 17 for feeding high-frequency power to the second antenna element 42, as shown in FIGS. 12 and 13.

The first antenna element 41 is arranged on a side of the passive element 43 along arrow X1, while the second antenna element 42 is arranged on another side of the passive element 43 along arrow X2. The first antenna element 41 (second antenna element 42) is in the form of a thin plate, and provided on a front surface 14*a* of the substrate 14. The first antenna element 41 (second antenna element 42) is a monopole antenna having an electrical length of substantially quarter a wavelength (120 mm) of 2.5 GHz corresponding to the multiantenna unit 40. More specifically, the first antenna element 41 (second antenna element 42) includes the first feeding point connecting portion 41*a* (second feeding point connecting portion 42*a*) whose end portion along arrow Y2 is connected to the first feeding point 16 (second feeding point 17) provided on the ground portion 15 arranged on the back surface 14*b* of the substrate 14 to extend along arrow Y1.

According to the second embodiment, each of the first feeding point connecting portion 41*a* of the first antenna element 41 and the second feeding point connecting portion

42*a* of the second antenna element 42 is provided in the shape bent on a plurality of positions.

The passive element 43 includes a first portion 431, a second portion 432, an extensional portion 433 and a third portion 434. The first portion 431 (second portion 432) is arranged on the front surface 14*a* of the substrate 14. The first portion 431 (second portion 432) includes a first opposed portion 431*a* (second opposed portion 432*a*), a third lateral portion 431*b* (fourth lateral portion 423*b*) and a fifth lateral portion 431*c* (sixth lateral portion 432*c*). The first opposed portion 431*a* (second opposed portion 432*a*) is arranged to be opposed to the first antenna element 41 (second antenna element 42). The third lateral portion 431*b* (fourth lateral portion 423*b*) is formed to be connected to an end portion of the first opposed portion 431*a* (second opposed portion 432*a*) along arrow Y1 and to extend along arrow X2 (along arrow X1). The fifth lateral portion 431*c* (sixth lateral portion 432*c*) is formed to be connected to an end portion of the first opposed portion 431*a* (second opposed portion 432*a*) along arrow Y2 and to extend along arrow X2 (along arrow X1).

The extensional portion 433 includes a first extensional portion 433*a* and a second extensional portion 433*b*. The first extensional portion 433*a* (second extensional portion 433*b*) is connected to an end portion of the fifth lateral portion 431*c* (sixth lateral portion 432*c*) of the first portion 431 along arrow X2 (along arrow X1), and arranged to extend in a direction (thickness direction (along arrow Z2) of the substrate 14) perpendicular to the front surface 14*a* of the substrate 14. The third portion 434 is arranged on the back surface 14*b* of the substrate 14. The third portion 434 includes a seventh lateral portion 434*a* (eighth lateral portion 434*b*) connected to the first extensional portion 433*a* (second extensional portion 433*b*) to extend along arrow X1 (along arrow X2), a first vertical portion 434*c* (second vertical portion 434*d*) connected to an end portion of the seventh lateral portion 434*a* (eighth lateral portion 434*b*) along arrow X1 (along arrow X2) to extend along arrow Y1 and a ninth lateral portion 434*e* connecting end portions of the first and second vertical portions 434*c* and 434*d* along arrow Y1 with each other. The passive element 43 is formed to be in a non-grounded state not grounded to the ground portion 15. The passive element 43 has an electrical length of substantially half the wavelength of 2.5 GHz corresponding to the multiantenna unit 40.

The remaining structure of the second embodiment is similar to that of the aforementioned first embodiment.

As hereinabove described, intercoupling between the first and second antenna elements 41 and 42 can be reduced while suppressing reduction of flexibility in wiring pattern design also in the structure according to the second embodiment, similarly to the aforementioned first embodiment. Further, the multiantenna unit 40 can be further downsized.

According to the second embodiment, as hereinabove described, each of the first and second feeding point connecting portions 41*a* and 42*a* of the first and second antenna elements 41 and 42 is provided in the shape bent on a plurality of positions so that lengths necessary for the first and second antenna elements 41 and 42 can be ensured due to the first and second feeding point connecting portions 41*a* and 42*a* each provided in the shape bent on a plurality of positions also when the first and second antenna elements 41 and 42 are arranged on small regions, whereby the regions for arranging the first and second antenna elements 41 and 42 may not be increased in size and hence multiantenna unit 40 can be further downsized.

The remaining effects of the second embodiment are similar to those of the aforementioned first embodiment.

Results of a simulation conducted for confirming effects of the aforementioned second embodiment are now described. In this simulation, a multiantenna unit 40 corresponding to the second embodiment shown in FIGS. 12 and 13 was compared with the multiantenna unit 20 according to first comparative example shown in FIGS. 6 and 7 and the multiantenna unit 30 according to second comparative example shown in FIGS. 9 and 10.

In the multiantenna unit 40 corresponding to the second embodiment, first and second antenna elements 41 and 42 were arranged to be separated from each other by a distance D41 of 21 mm, as shown in FIGS. 12 and 13. Further, a passive element 43 was so arranged that the first antenna element 41 (second antenna element 42) and a first opposed portion 431*a* (second opposed portion 432*a*) were separated from each other by a distance D42 of 4 mm. An extensional portion 433 (first and second extensional portions 433*a* and 433*b*) has a length of 1 mm, which is substantially equal to the thickness of a substrate 14. The first and second antenna elements 41 and 42 and the passive element 43 of the multiantenna unit 40 are arranged in a rectangular region of 31 mm and 14 mm in directions X and Y.

Figure 14:
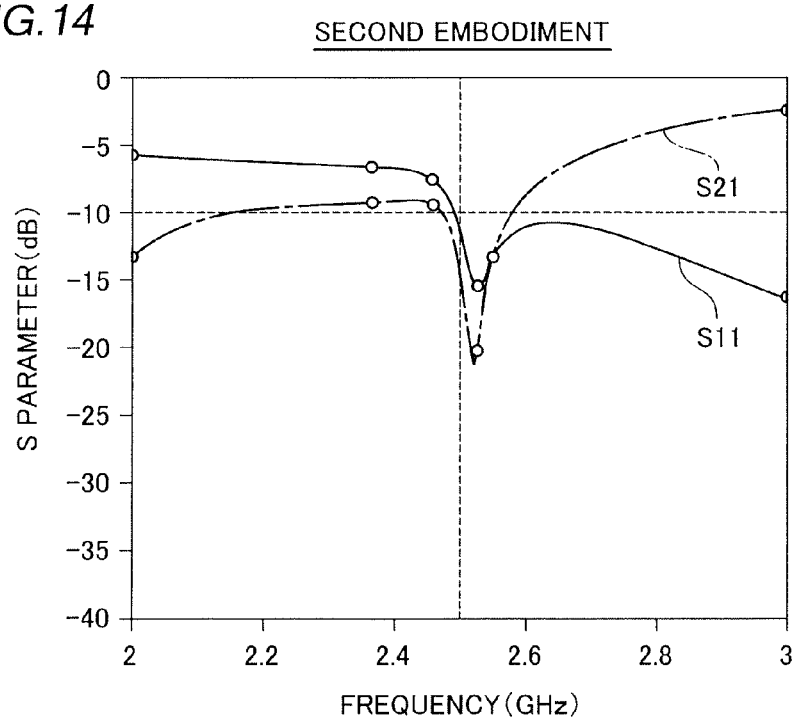
FIG. 14 illustrates the characteristics of S parameters in a simulation of a multiantenna unit corresponding to the second embodiment of the present invention.

The characteristics of S parameters of the multiantenna unit 40 corresponding to the second embodiment and the multiantenna units 20 and 30 according to first and second comparative examples are now described with reference to FIGS. 14, 8 and 11. Referring to FIGS. 14, 8 and 11, the axes of ordinates show frequencies, and the axes of abscissas show the magnitudes (unit: dB) of parameters S11 and S21.

In the multiantenna unit 40 corresponding to the second embodiment, the parameters S11 and S21 were about −17 dB and about −15 dB respectively at the frequency of 2.5 GHz corresponding to the multiantenna unit 40, as shown in FIG. 14. In the multiantenna unit 20 according to first comparative example, on the other hand, the parameters S11 and S21 were about −13 dB and about −9.6 dB respectively at the frequency of 2.5 GHz as described above, as shown in FIG. 8. In the multiantenna unit 30 according to second comparative example, the parameters S11 and S21 were about −16 dB and about −23 dB respectively at the frequency of 2.5 GHz, as shown in FIG. 11.

Consequently, the multiantenna unit 40 corresponding to the second embodiment has the parameter S21, indicating the magnitude of intercoupling between the first and second antenna elements 41 and 42, smaller than that of the multiantenna unit 20 according to first comparative example, and hence it has been proved that the intercoupling between the first and second antenna elements 41 and 42 can be reduced by providing the non-grounded passive element 43.

This is conceivably for the following reason: In the multiantenna unit 40 corresponding to the second embodiment, direct coupling resulting from a current flowing in either the first antenna element 41 or the second antenna element 42 and indirect coupling resulting from a current flowing in the passive element 43 are conceivably caused in the first and second antenna elements 41 and 42, to reduce the intercoupling between the first and second antenna elements 41 and 42.

Also in the multiantenna unit 40 corresponding to the second embodiment, the parameter S21 indicating the magnitude of the intercoupling between the first and second antenna elements 41 and 42 was not more than −10 dB, similarly to the multiantenna unit 30 according to second comparative example. Therefore, it has been proved that the intercoupling between the first and second antenna elements 41 and 42 can be reduced also when the passive element 43 is arranged on the front surface 14*a* of the substrate 14, a portion of the substrate 14 in the thickness direction and the back surface

14*b* of the substrate 14 to reduce the size of the region for arranging the multiantenna unit 40.

(Third Embodiment)

A multiantenna unit 50 of a portable apparatus 100 according to a third embodiment of the present invention is now described with reference to FIGS. 15 and 16. In the multiantenna unit 50 according to the third embodiment, a first extensional portion 533*a* and a second extensional portion 533*b* of a passive element 53 are connected to end portions of a first portion 531 and a second portion 532 farther from a ground portion 15 (along arrow Y1) respectively, dissimilarly to the aforementioned first and second embodiments.

Figure 15:
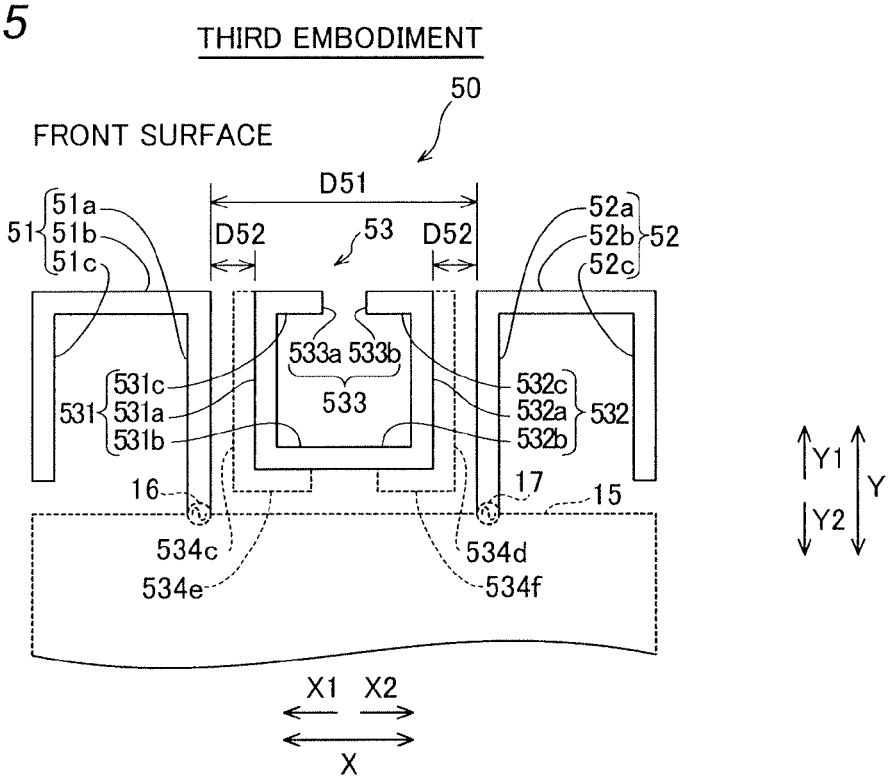
FIG. 15 is a plan view showing a front surface of a multiantenna unit of the portable apparatus according to the third embodiment of the present invention.
Figure 16:
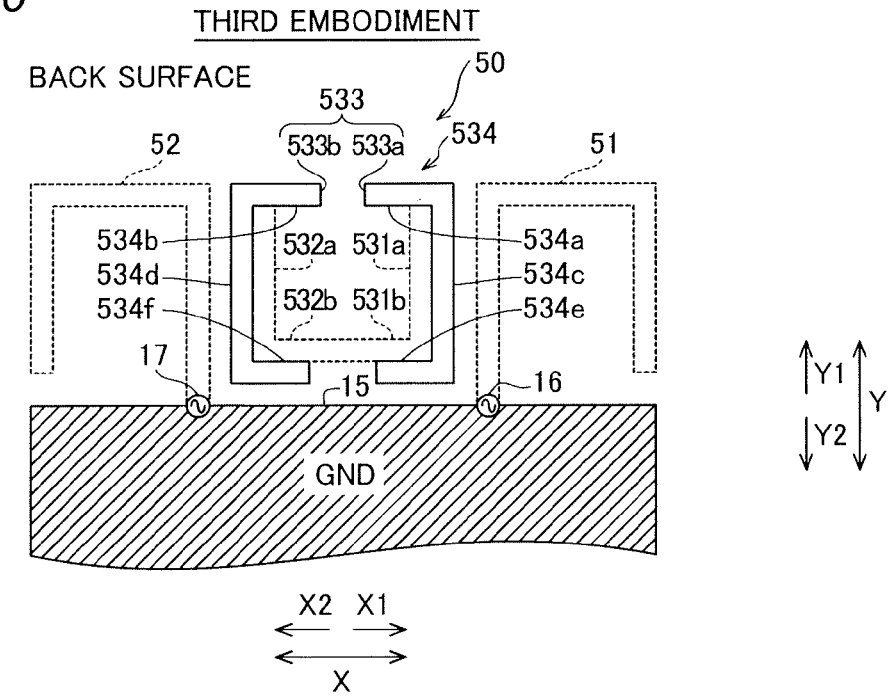
FIG. 16 is a plan view showing a back surface of the multiantenna unit of the portable apparatus according to the third embodiment of the present invention.

The multiantenna unit 50 of the portable apparatus 100 according to the third embodiment includes first and second antenna elements 51 and 52, the passive element 53 arranged between the first and second antenna elements 51 and 52, a substrate 14 (see FIG. 4), the ground portion 15, a first feeding point 16 for feeding high-frequency power to the first antenna element 51 and a second feeding point 17 for feeding high-frequency power to the second antenna element 52, as shown in FIGS. 15 and 16.

The first antenna element 51 is arranged on a side of the passive element 53 along arrow X1, while the second antenna element 52 is arranged on another side of the passive element 53 along arrow X2. The first antenna element 51 (second antenna element 52) is in the form of a thin plate, and provided on a front surface 14*a* of the substrate 14. The first antenna element 51 (second antenna element 52) is a monopole antenna having an electrical length of substantially quarter a wavelength (115 mm) of 2.6 GHz corresponding to the multiantenna unit 50. More specifically, the first antenna element 51 (second antenna element 52) is substantially inversely U-shaped. The first antenna element 51 (second antenna element 52) includes a first feeding point connecting portion 51*a* (second feeding point connecting portion 52*a*), a first lateral portion 51*b* (second lateral portion 52*b*) and a third vertical portion 51*c* (fourth vertical portion 52*c*). The first feeding point connecting portion 51*a* (second feeding point connecting portion 52*a*) is so formed that an end portion along arrow Y2 is connected to the first feeding point 16 (second feeding point 17) provided on the ground portion 15 arranged on a back surface 14*b* of the substrate 14 to extend along arrow Y1. The first lateral portion 51*b* (second lateral portion 52*b*) is formed to be connected to an end portion of the first feeding point connecting portion 51*a* (second feeding point connecting portion 52*a*) along arrow Y1 and to extend along arrow X1 (along arrow X2). The third vertical portion 51*c* (fourth vertical portion 52*c*) is formed to be connected to an end portion of the first lateral portion 51*b* (second lateral portion 52*b*) along arrow X1 (along arrow X2) and to extend along arrow Y2.

The passive element 53 includes the first portion 531, the second portion 532, an extensional portion 533 and a third portion 534. The first portion 531 (second portion 532) is arranged on the front surface 14*a* of the substrate 14. The first portion 531 (second portion 532) includes a first opposed portion 531*a* (second opposed portion 532*a*), a third lateral portion 531*b* (fourth lateral portion 532*b*) and a fifth lateral portion 531*c* (sixth lateral portion 532*c*). The first opposed portion 531*a* (second opposed portion 532*a*) is arranged to be opposed to the first feeding point connecting portion 51*a* of the first antenna element 51 (second feeding point connecting portion 52*a* of the second antenna element 52). The third lateral portion 531*b* (fourth lateral portion 532*b*) is formed to be connected to an end portion of the first opposed portion 531*a* (second opposed portion 532*a*) along arrow Y2 and to extend along arrow X2 (along arrow X1). The fifth lateral portion 531*c* (sixth lateral portion 532*c*) is formed to be connected to an end portion of the first opposed portion 531*a* (second opposed portion 532*a*) along arrow Y1 and to extend along arrow X2 (along arrow X1). The first and second portions 531 and 532 are connected with each other by the third and fourth lateral portions 531*b* and 532*b*.

The extensional portion 533 includes the first extensional portion 533*a* and the second extensional portion 533*b*. The first extensional portion 533*a* (second extensional portion 533*b*) is connected to an end portion of the fifth lateral portion 531*c* of the first portion 531 (sixth lateral portion 532*c* of the second portion 532) along arrow X2 (along arrow X1), and arranged to extend in a direction (thickness direction (along arrow Z2) of the substrate 14) perpendicular to the front surface 14*a* of the substrate 14. The third portion 532 is arranged on the back surface 14*b* of the substrate 14. The third portion 534 includes a seventh lateral portion 534*a* (eighth lateral portion 534*b*) connected to the first extensional portion 533*a* (second extensional portion 533*b*) to extend along arrow X1 (along arrow X2), a first vertical portion 534*c* (second vertical portion 534*d*) connected to an end portion of the seventh lateral portion 534*a* (eighth lateral portion 534*b*) along arrow X1 (along arrow X2) to extend along arrow Y2 and a ninth lateral portion 534*e* (tenth lateral portion 534*f*) connected to an end portion of the first vertical portion 534*c* (second vertical portion 534*d*) along arrow Y2 to extend along arrow X2 (along arrow X1). The passive element 53 has an electrical length of substantially half the wavelength of 2.6 GHz corresponding to the multiantenna unit 50.

According to the third embodiment, the first opposed portion 531*a* and the third lateral portion 531*b* of the first portion 531 of the passive element 53 and the first vertical portion 534*c* and the ninth lateral portion 534*e* of the third portion 534 are arranged not to overlap with each other in plan view. Further, the second opposed portion 532*a* and the fourth lateral portion 532*b* of the second portion 532 and the second vertical portion 534*d* and the tenth lateral portion 534*f* of the third portion 534 are arranged not to overlap with each other in plan view.

The remaining structure of the third embodiment is similar to that of the aforementioned first embodiment.

As hereinabove described, intercoupling between the first and second antenna elements 51 and 52 can be reduced while suppressing reduction of flexibility in wiring pattern design also in the structure according to the third embodiment, similarly to the aforementioned first embodiment. Further, the multiantenna unit 50 can be further downsized.

According to the third embodiment, as hereinabove described, the intercoupling between the first and second antenna elements 51 and 52 can be reduced also when the first and second extensional portions 533*a* and 533*b* of the passive element 53 are arranged to be connected to the end portions of the first and second portions 531 and 532 farther from the ground portion 15 (along arrow Y1) respectively.

The remaining effects of the third embodiment are similar to those of the aforementioned first embodiment.

Results of a simulation conducted for confirming effects of the aforementioned third embodiment are now described. In this simulation, a multiantenna unit 50 corresponding to the third embodiment shown in FIGS. 15 and 16 was compared with the multiantenna unit 20 according to first comparative example shown in FIGS. 6 and 7 and the multiantenna unit 30 according to second comparative example shown in FIGS. 9 and 10.

In the multiantenna unit 50 corresponding to the third embodiment, first and second antenna elements 51 and 52 were so arranged that first and second feeding point connecting portions 51*a* and 52*a* were separated from each other by a distance D51 of 12 mm, as shown in FIGS. 15 and 16. Further, a passive element 53 was so arranged that the first feeding point connecting portion 51*a* (second feeding point connecting portion 52*a*) and a first opposed portion 531*a* (second opposed portion 532*a*) were separated from each other by a distance D52 of 2 mm. An extensional portion 533 (first and second extensional portions 533*a* and 533*b*) has a length of 1 mm, which is substantially equal to the thickness of a substrate 14. The first and second antenna elements 51 and 52 and the passive element 53 of the multiantenna unit 50 are arranged in a rectangular region of 28 mm and 10 mm in directions X and Y.

Figure 17:
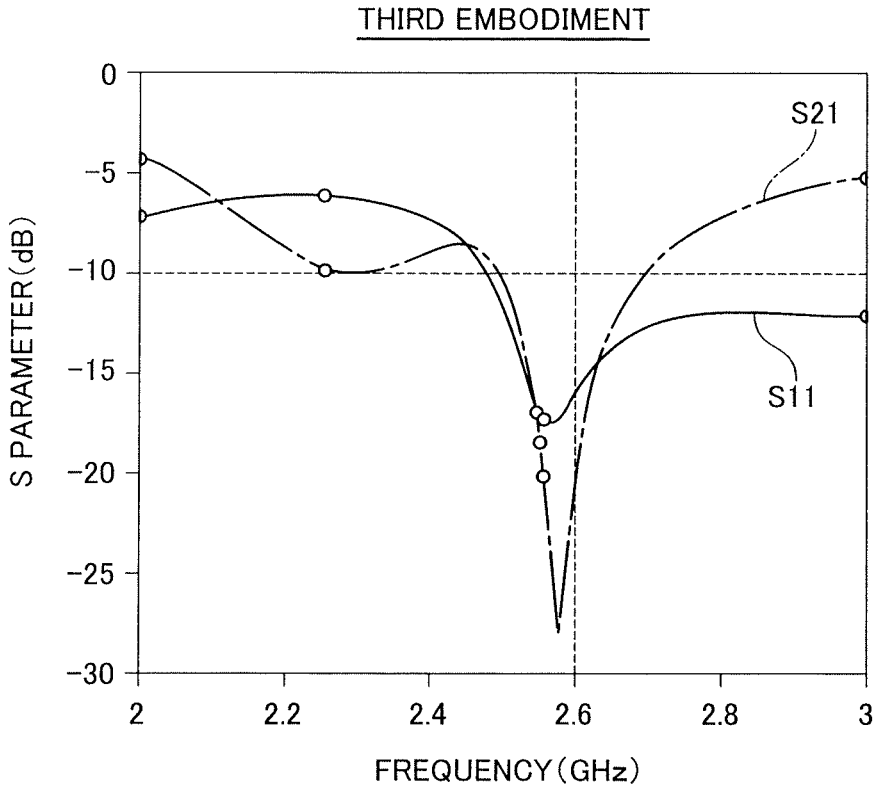
FIG. 17 illustrates the characteristics of S parameters in a simulation of a multiantenna unit corresponding to the third embodiment of the present invention.

The characteristics of S parameters of the multiantenna unit 50 corresponding to the third embodiment and the multiantenna units 20 and 30 according to first and second comparative examples are now described with reference to FIGS. 17, 8 and 11. Referring to FIGS. 17, 8 and 11, the axes of ordinates show frequencies, and the axes of abscissas show the magnitudes (unit: dB) of parameters S11 and S21.

In the multiantenna unit 50 corresponding to the third embodiment, the parameters S11 and S21 were about −16 dB and about −22 dB respectively at the frequency of 2.6 GHz corresponding to the multiantenna unit 50, as shown in FIG. 17. In the multiantenna unit 20 according to first comparative example, on the other hand, the parameters S11 and S21 were about −13 dB and about −9.6 dB respectively at the frequency of 2.5 GHz as described above, as shown in FIG. 8. In the multiantenna unit 30 according to second comparative example, the parameters S11 and S21 were about −16 dB and about −23 dB respectively at the frequency of 2.5 GHz, as shown in FIG. 11.

Consequently, the multiantenna unit 50 corresponding to the third embodiment has the parameter S21, indicating the magnitude of the intercoupling between the first and second antenna elements 51 and 52, smaller than that of the multiantenna unit 20 according to first comparative example, and hence it has been proved that the intercoupling between the first and second antenna elements 51 and 52 can be reduced by providing the non-grounded passive element 43.

This is conceivably for the following reason: In the multiantenna unit 50 corresponding to the third embodiment, direct coupling resulting from a current flowing in either the first antenna element 51 or the second antenna element 52 and indirect coupling resulting from a current flowing in the passive element 53 are conceivably caused in the first and second antenna elements 51 and 52, to reduce the intercoupling between the first and second antenna elements 51 and 52.

Also in the multiantenna unit 50 corresponding to the third embodiment, the parameter S21 indicating the magnitude of the intercoupling between the first and second antenna elements 51 and 52 was not more than −10 dB, similarly to the multiantenna unit 30 according to second comparative example. Therefore, it has been proved that the intercoupling between the first and second antenna elements 51 and 52 can be reduced also when the passive element 53 is arranged on the front surface 14*a* of the substrate 14, a portion of the substrate 14 in the thickness direction and the back surface 14*b* of the substrate 14 to reduce the size of the region for arranging the multiantenna unit 50.

(Fourth Embodiment)

The structure of a portable telephone 200 according to a fourth embodiment of the present invention is now described with reference to FIGS. 28 and 29. In the structure of the portable telephone 200 according to the fourth embodiment, a passive element 73 of a multiantenna unit 70 is formed on one surface, dissimilarly to the aforementioned first to third embodiments. The portable telephone 200 is an example of the "communication apparatus" in the present invention.

Figure 28:
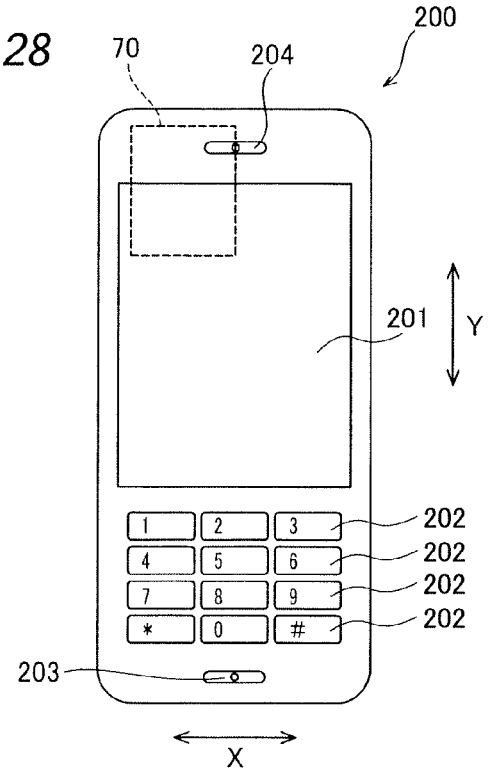
FIG. 28 is a plan view showing the overall structure of a portable telephone according to a fourth embodiment of the present invention.

The portable telephone 200 according to the fourth embodiment has a substantially rectangular shape in front elevational view, as shown in FIG. 28. The portable telephone 200 includes a display screen portion 1, operation portions 202 consisting of number buttons or the like, a microphone 203 and a speaker 204. The multiantenna unit 70 is provided in a housing of the portable telephone 200.

The multiantenna unit 70 is structured for MIMO (Multiple-Input Multiple-Output) communication allowing multiple inputs/outputs at a prescribed frequency with a plurality of antenna elements. Further, the multiantenna unit 70 corresponds to a WiMAX (Worldwide interoperability for Microwave Access) system of a high-frequency radio communication network in the band of 2.5 GHz.

Figure 29:
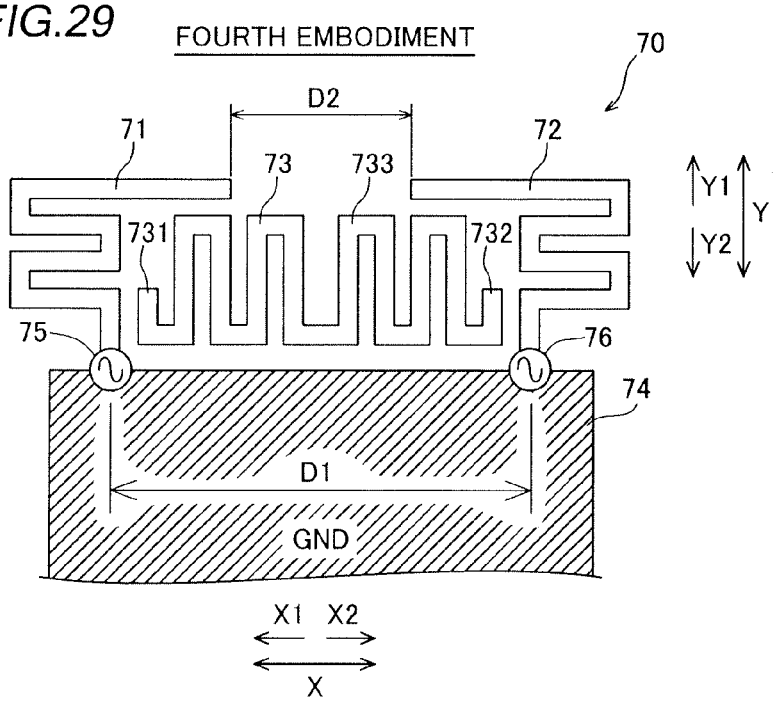
FIG. 29 is a plan view showing a multiantenna unit of the portable telephone according to the fourth embodiment of the present invention.

The multiantenna unit 70 includes first and second antenna elements 71 and 72, the passive element 73 arranged between the first and second antenna elements 71 and 72 and a ground plane 74, as shown in FIG. 29. The multiantenna unit 70 further includes a first feeding point 75 for feeding high-frequency power to the first antenna element 71 and a second feeding point 76 for feeding high-frequency power to the second antenna element 72.

The first antenna element 71 is arranged on a side of the passive element 73 along arrow X1, while the second antenna element 72 is arranged on another side of the passive element 73 along arrow X2. The first antenna element 71 (second antenna element 72) is in the form of a thin plate, and provided on a surface of a substrate (not shown). The first antenna element 71 (second antenna element 72) is a monopole antenna having an electrical length of substantially quarter the wavelength λ of 2.5 GHz corresponding to the multiantenna unit 70. More specifically, an end portion of the first antenna element 71 (second antenna element 72) along arrow Y1 is open, while another end portion along arrow Y2 is grounded to the ground plane 74 through the first feeding point 75 (second feeding point 76).

The first antenna element 71 (second antenna element 72) is provided in a shape bent on a plurality of positions. Thus, the size of a space for arranging the first antenna element 71 (second antenna element 72) can be inhibited from increase in a direction Y. The end portion (open end portion) of the first antenna element 71 along arrow Y1 is arranged on a side (along arrow X2) closer to the second antenna element 72 than the end portion (end portion grounded to the ground plane 74) along arrow Y2. The first and second antenna elements 71 and 72 are so arranged that the feeding points 75 and 76 therefor are separated from each other by a distance D1 of less than λ/4. Further, the first and second antenna elements 71 and 72 are so arranged that the same are separated from each other at a minimum distance D2 between the end portions (open end portions) along arrow Y1. In other words, the first and second antenna elements 71 and 72 are so arranged that the distance D2 therebetween on the end portions (open end portions) along arrow Y1 is smaller than the distance D1 between the feeding points 75 and 76. The electrical length denotes not a physical length, but a length with reference to one wavelength of a signal proceeding on a conductor constituting an antenna.

The passive element 73 has a first coupling portion 731 arranged at a couplable distance from the first antenna element 71, a second coupling portion 732 arranged at a couplable distance from the second antenna element 72 and a connecting portion 733 connecting the first and second coupling portions 731 and 732 with each other. The passive element 73 is provided in a non-grounded state not grounded to the ground plane 74. Further, the passive element 73 has an electrical length of about λ/2. In addition, the passive element 73 is formed to be resonated due to currents flowing in the first and second antenna elements 71 and 72. In the fourth embodiment, the couplable distance denotes a distance allowing electromagnetic field coupling including electrostatic coupling and magnetic field coupling.

The first and second coupling portions 731 and 732 are arranged to be opposed to the first and second antenna elements 71 and 72 respectively. Further, the first and second coupling portions 731 and 732 are formed to extend in the direction Y.

The connecting portion 733 is formed to connect end portions of the first and second coupling portions 731 and 732 along arrow Y2 with each other. Further, the connecting portion 733 is formed to extend from first sides to second sides of the first and second antenna elements 71 and 72 (to extend in a direction X). In addition, the connecting portion 733 is provided in a shape bent on a plurality of positions. More specifically, the connecting portion 733 is formed to extend in the direction X as a whole while being bent in the direction Y on the plurality of positions.

The first feeding point 75 (second feeding point 76) is arranged on the end portion of the first antenna element 71 (second antenna element 72) along arrow Y2. Further, the first feeding point 75 (second feeding point 76) connects the first antenna element 71 (second antenna element 72) with a feeder (not shown).

According to the fourth embodiment, the non-grounded passive element 73 including the first coupling portion 731 coupled to the first antenna element 71, the second coupling portion 732 coupled to the second antenna element 72 and the connecting portion 733 connecting the first and second coupling portions 731 and 732 with each other is arranged between the first and second antenna elements 71 and 72, whereby intercoupling between the first and second antenna elements 71 and 72 can be reduced. Further, the passive element 73 is so rendered non-grounded that the same may not be grounded to the ground plane 74, whereby reduction of flexibility in wiring pattern design can be suppressed. In the multiantenna unit 70, therefore, the intercoupling between the first and second antenna elements 71 and 72 can be reduced while suppressing reduction of flexibility in wiring pattern design. Further, the intercoupling between the first and second antenna elements 71 and 72 can be so reduced that the distance between the first and second antenna elements 71 and 72 may not be increased in order to reduce the intercoupling therebetween, whereby the multiantenna unit 70 can be downsized. In addition, a length necessary for the passive element 73 can be ensured due to the bent shape of the connecting portion 733 connecting the first and second coupling portions 731 and 732 with each other, whereby a space for arranging the passive element 73 may not be increased in size and hence the multiantenna unit 70 can be further downsized. Consequently, the communication apparatus including such a multiantenna unit 70 itself can also be downsized. The present invention is particularly effective in the communication apparatus such as the portable telephone 200 according to the fourth embodiment, to which downsizing is expected.

As hereinabove described, the inventor has found that the intercoupling between the first and second antenna elements 71 and 72 can be reduced while suppressing reduction of flexibility in wiring pattern design and the multiantenna unit 70 can be further downsized by arranging the non-grounded passive element 73 including the first coupling portion 731 coupled to the first antenna element 71, the second coupling portion 732 coupled to the second antenna element 72 and the connecting portion 733 connecting the first and second coupling portions 731 and 732 with each other between the first and second antenna elements 71 and 72 and at least partially providing the passive element 73 in the bent shape.

According to the fourth embodiment, the connecting portion 733 of the passive element 73 is provided in the bent shape. According to this structure, the length necessary for the passive element 73 can be ensured due to the bent shape in the limited space between the first and second antenna elements 71 and 72, whereby the space for arranging the passive element 73 may not be increased in size and hence the multiantenna unit 70 can be further downsized.

According to the fourth embodiment, the passive element 73 is formed to have the electrical length of substantially half the wavelength λ of electric waves output from the first and second antenna elements 71 and 72. According to this structure, the non-grounded passive element 73 can be resonated.

Results of a simulation conducted for confirming effects of the fourth embodiment are now described. In this simulation, a multiantenna unit 70 corresponding to the fourth embodiment shown in FIG. 29 was compared with a multiantenna unit 80 according to third comparative example shown in FIG. 30.

In the multiantenna unit 70 corresponding to the fourth embodiment, first and second antenna elements 71 and 72 were so arranged that a distance D1 between feeding points 75 and 76 was 22 mm, i.e., less than λ/4. Further, the first and second antenna elements 71 and 72 were so arranged that a minimum distance D2 therebetween was 10 mm. While the first and second antenna elements 71 and 72 and the passive element 73 are provided on the front surface of the substrate (not shown) in the fourth embodiment, the first and second antenna elements 71 and 72 and a passive element 73 were provided in a vacuum in this simulation. Further, the first and second antenna elements 71 and 72 and the passive element 73 were constituted of conductors of 0 mm in thickness, in order to conduct the simulation according to a system corresponding to two dimensions. The multiantenna unit 70 corresponding to the fourth embodiment corresponds to 2.5 GHz, and exhibits a wavelength λ of 120 mm.

Figure 30:
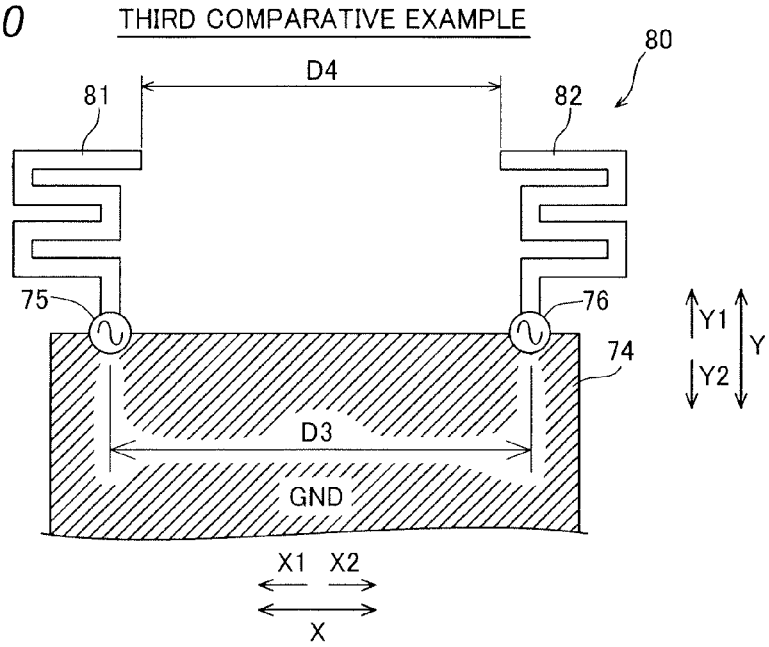
FIG. 30 is a plan view showing a multiantenna unit according to third comparative example.

In the multiantenna unit 80 according to third comparative example, no passive element was provided between first and second antenna elements 81 and 82 as shown in FIG. 30, dissimilarly to the multiantenna unit 70 according to the fourth embodiment provided with the non-grounded passive element 73. In the multiantenna unit 80 according to third comparative example, further, the first and second antenna elements 81 and 82 were so arranged that feeding points therefor were separated from each other by a distance D3 of 22 mm, i.e., less than λ/4. In addition, the first and second antenna elements 81 and 82 were so arranged that a minimum distance D4 therebetween was 20 mm. The remaining structure of the multiantenna unit 80 according to third comparative example is similar to that of the multiantenna unit 70 corresponding to the fourth embodiment.

Figure 31:
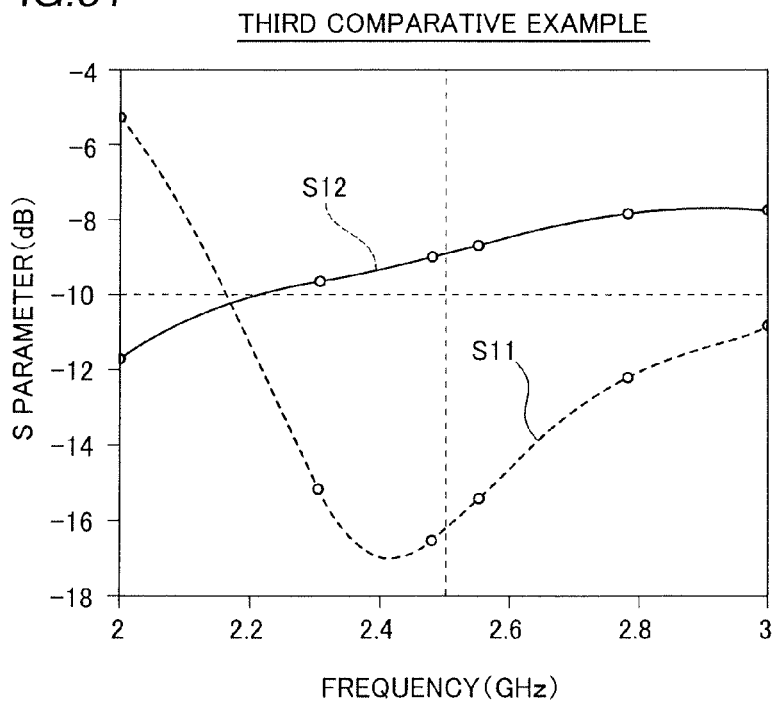
FIG. 31 illustrates the characteristics of S parameters in a simulation of the multiantenna unit according to third comparative example.
Figure 32:
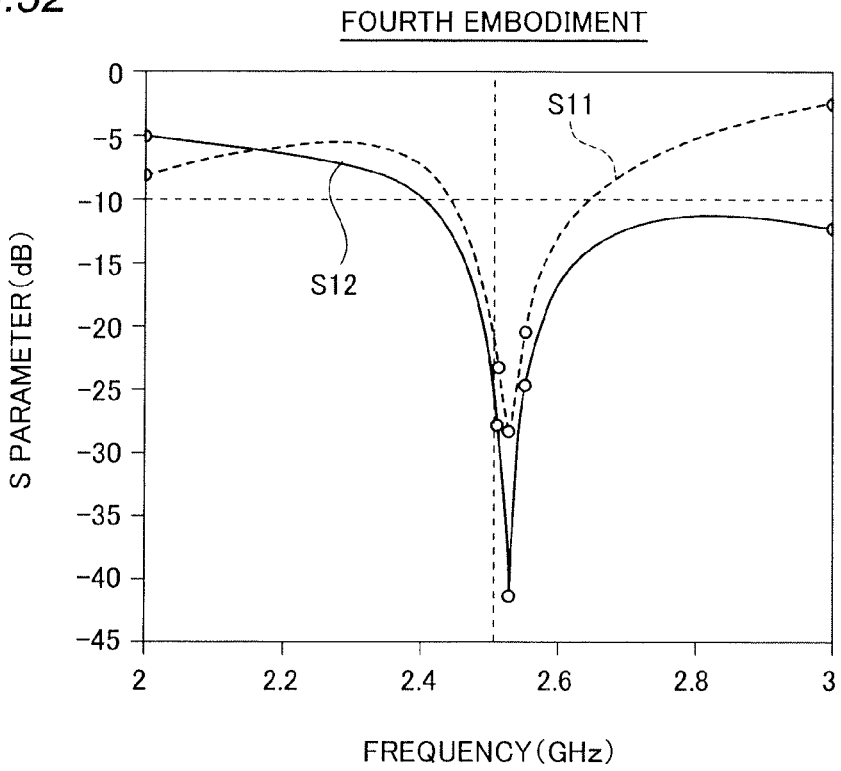
FIG. 32 illustrates the characteristics of S parameters in a simulation of a multiantenna unit corresponding to the fourth embodiment of the present invention.

The characteristics of S parameters of the multiantenna unit 80 corresponding to third comparative example and the multiantenna unit 70 corresponding to the fourth embodiment are now described with reference to FIGS. 31 and 32. In the S parameters shown in FIGS. 31 and 32, parameters S11 indicate magnitudes of reflection coefficients of the antenna elements 81 and 82 and 71 and 72, and parameters S12 indicate magnitudes of intercoupling between the pairs of antenna elements 81 and 82 and 71 and 72. Referring to FIGS. 31 and 32, the axes of ordinates show frequencies, and the axes of abscissas show the magnitudes (unit: dB) of the parameters S11 and S12.

In the multiantenna unit 80 according to third comparative example, the parameters S11 and S12 were about −16 dB and about −9 dB respectively at a frequency of 2.5 GHz, as shown in FIG. 31. In the multiantenna unit 70 corresponding to the fourth embodiment, on the other hand, the parameters S11 and S12 were about −20 dB and about −25dB respectively at the frequency of 2.5 GHz corresponding to the multiantenna unit 70, as shown in FIG. 32.

Consequently, the multiantenna unit 70 corresponding to the fourth embodiment has the parameter S12, indicating the strength (magnitude) of the intercoupling between the first and second antenna elements 71 and 72, smaller than that of the multiantenna unit 80 according to third comparative example, and hence it has been confirmed that the intercoupling between the first and second antenna elements 71 and 72 can be reduced by providing the non-grounded passive element 73 having the bent shape. If the parameter S12 is not more than −10 dB, the intercoupling between the first and second antenna elements 71 and 72 is conceivably small.

This is conceivably for the following reason: In the multiantenna unit 70 corresponding to the fourth embodiment, direct coupling resulting from a current flowing in either the first antenna element 71 or the second antenna element 72 and indirect coupling resulting from a current flowing in the passive element 73 are conceivably caused in the first and second antenna elements 71 and 72, to cancel the intercoupling between the first and second antenna elements 71 and 72.

Further, the multiantenna unit 70 corresponding to the fourth embodiment has the parameter S11, indicating the reflection coefficients of the first and second antenna elements 71 and 72, smaller than that of the multiantenna unit 80 according to third comparative example, and hence it has been confirmed that the first and second antenna elements 71 and 72 can efficiently output electric waves due to the provision of the non-grounded passive element 73 having the bent shape.

Although the present invention has been illustrated in detail, it is clearly understood that the same is by way of illustration and example only and is not to be taken by way of limitation, the spirit and scope of the present invention being limited only by the terms of the appended claims.

For example, while the multiantenna unit according to the present invention is applied to the portable apparatus in each of the aforementioned first to third embodiments, the present invention is not restricted to this. The multiantenna unit according to the present invention may alternatively be applied to a communication apparatus, such as an apparatus for wireless LAN or broadband communication loaded with an MIMO system, for example, other than the portable apparatus.

While the extensional portion is connected to the first and second portions in each of the aforementioned first to third embodiments, the present invention is not restricted to this. According to the present invention, the extensional portion may not be connected to both of the first and second portions, so far as the same is connected to at least either the first portion or the second portion.

While the front surface and the back surface of the substrate are employed as the examples of the first and second surfaces respectively in each of the aforementioned first to third embodiments, the present invention is not restricted to this. According to the present invention, the substrate may be formed in a multilayer structure so that either the first surface or the second surface is formed by an inner surface of the multilayer substrate or both of the first and second surfaces are formed by inner surfaces of the multilayer substrate.

While the first antenna element and the first opposed portion are arranged in the same plane and the second antenna element and the second opposed portion are arranged in the same plane in each of the aforementioned first to third embodiments, the present invention is not restricted to this. According to the present invention, the first antenna element and the first opposed portion as well as the second antenna element and the second opposed portion may not be arranged in the same planes, so far as the same are arranged to be opposed to each other.

While the first and second antenna elements are arranged in the same plane in each of the aforementioned first to third embodiments, the present invention is not restricted to this. According to the present invention, the first and second antenna elements may alternatively arranged in different planes.

While the first and second antenna elements and the first and second feeding points are arranged in different planes in each of the aforementioned first to third embodiments, the present invention is not restricted to this. According to the present invention, the first and second antenna elements and the first and second feeding points may alternatively be arranged in the same plane.

Figure 18:
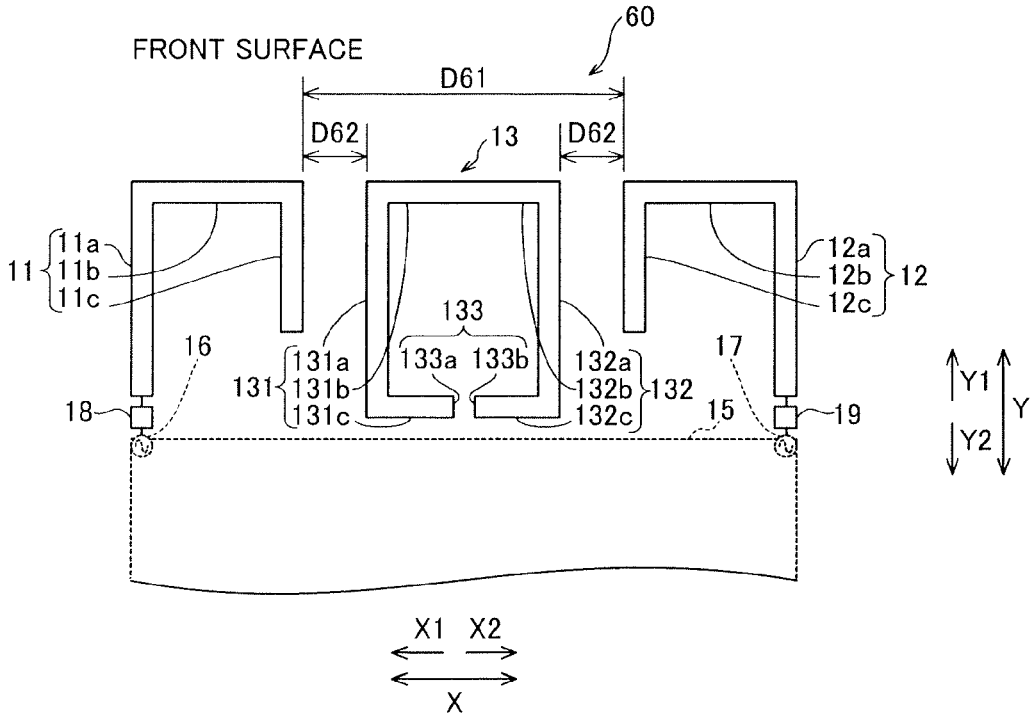
FIG. 18 is a plan view showing a front surface of a multiantenna unit of a portable apparatus according to a first modification of the first embodiment of the present invention.
Figure 19:
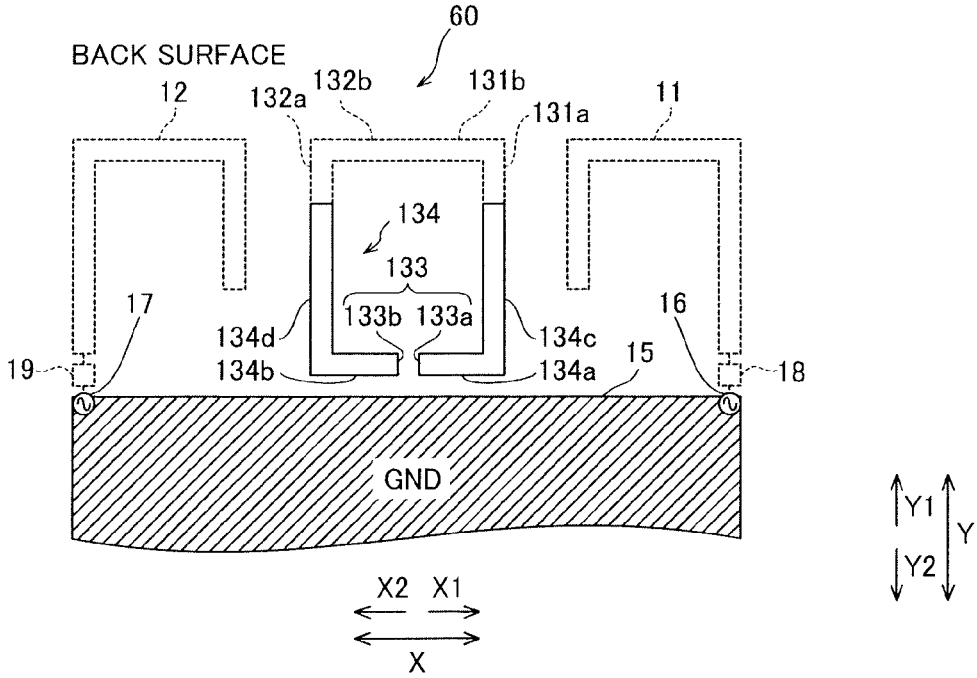
FIG. 19 is a plan view showing a back surface of the multiantenna unit of the portable apparatus according to the first modification of the first embodiment of the present invention.
Figure 20:
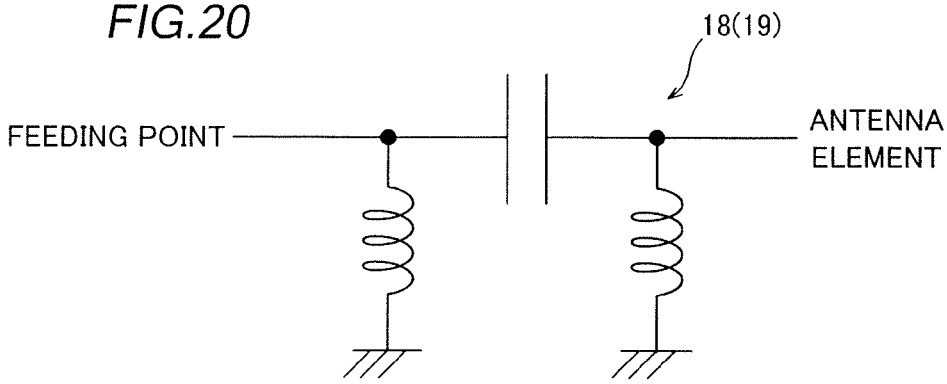
FIG. 20 illustrates a π matching circuit of the multiantenna unit of the portable apparatus according to the first modification shown in FIGS. 18 and 19.
Figure 21:
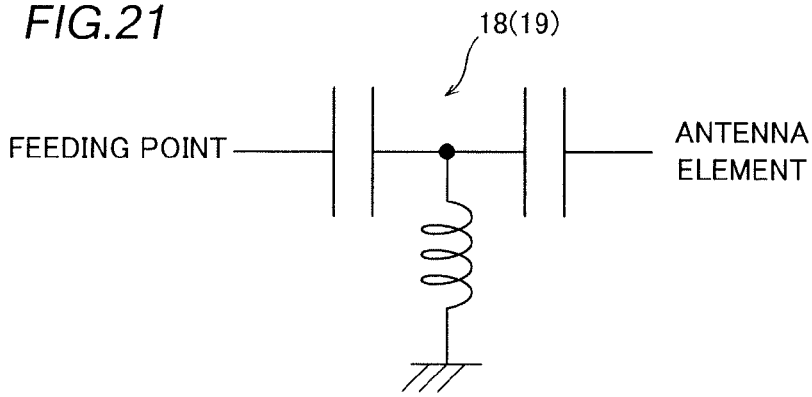
FIG. 21 illustrates a T matching circuit of the multiantenna unit of the portable apparatus according to the first modification shown in FIGS. 18 and 19.
Figure 22:
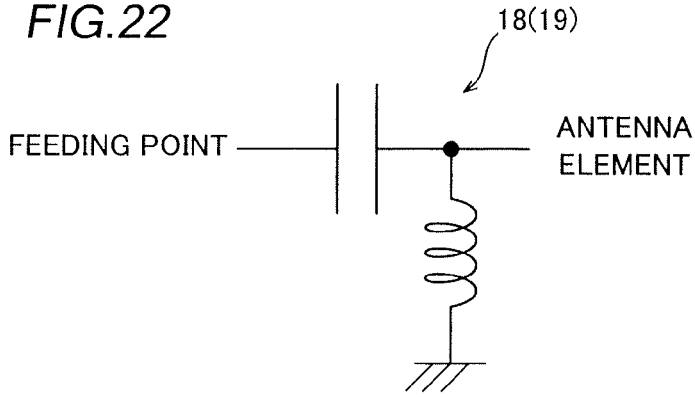
FIG. 22 illustrates an L matching circuit of the multiantenna unit of the portable apparatus according to the first modification shown in FIGS. 18 and 19.

While no matching circuits for attaining impedance matching are provided between the feeding points and the antenna elements in each of the aforementioned first to third embodiments, the present invention is not restricted to this. According to the present invention, matching circuits for suppressing intercoupling between the antenna elements while attaining impedance matching at a prescribed frequency of high-frequency power may alternatively be provided between the feeding points and the antenna elements. For example, a first matching circuit 18 (second matching circuit 19) may be provided between a first feeding point 16 (second feeding point 17) and a first antenna element 11 (second antenna element 12) of a multiantenna unit 60, as shown in FIGS. 18 and 19. Thus, intercoupling between the first and second antenna elements 11 and 12 can be reduced and impedance matching is attained at a prescribed frequency, whereby transmission loss of energy transmitted through the first and second antenna elements 11 and 12 can be further reduced. The first matching circuit 18 (second matching circuit 19) may be constituted of a π circuit (π matching circuit) constituted of inductors (coils) and capacitors as shown in FIG. 20, a T circuit (T matching circuit) constituted of an inductor and a capacitor as shown in FIG. 21, or an L circuit (L matching circuit) constituted of an inductor and a capacitor as shown in FIG. 22, for example. Further, the π circuit, the T circuit or the L circuit may be constituted of only either the inductor(s) or the capacitor(s), or both of the inductor(s) and the capacitor(s).

While the multiantenna unit for MIMO communication is employed as the example of the multiantenna unit in each of the aforementioned first to third embodiments, the present invention is not restricted to this. The present invention may alternatively be applied to a multiantenna unit corresponding to a system, such as a diversity system, for example, other than the MIMO system.

Figure 23:
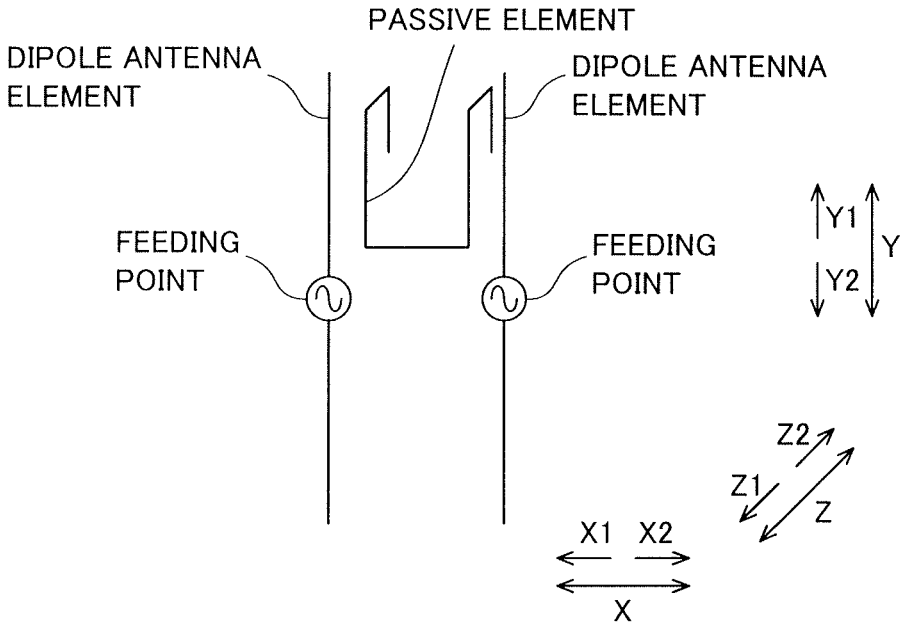
FIG. 23 schematically illustrates a multiantenna unit consisting of dipole antennas according to a second modification of each of the first to third embodiments of the present invention.
Figure 24:
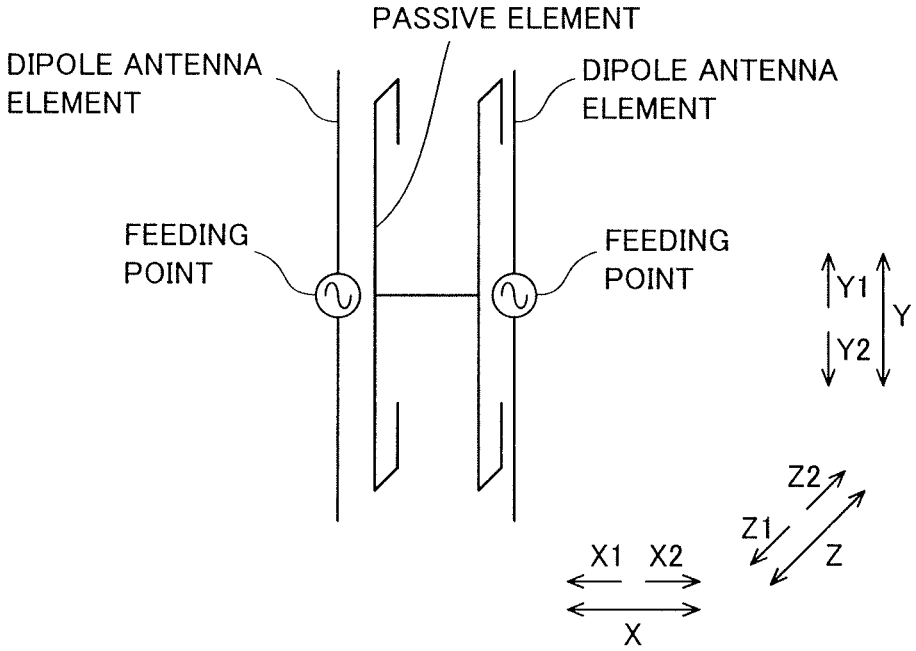
FIG. 24 schematically illustrates a multiantenna unit consisting of dipole antennas according to a third modification of each of the first to third embodiments of the present invention.

While the first antenna element (second antenna element) consisting of the monopole antenna is employed as an example of the first antenna element (second antenna element) in each of the aforementioned first to third embodiments, the present invention is not restricted to this. According to the present invention, the first antenna element (second antenna element) may alternatively consist of an antenna, such as a dipole antenna, other than the monopole antenna. In a case of a first antenna element (second antenna element)

consisting of a dipole antenna, for example, a non-grounded passive element including an extensional portion may be provided to correspond to a portion of the first antenna element (second antenna element) closer to a side along arrow Y1 than a feeding point, as shown in FIG. 23. Alternatively, a non-grounded passive element including an extensional portion may be provided to correspond to both of portions of a first antenna element (second antenna element), consisting of a dipole antenna, closer to sides along arrows Y1 and Y2 than a feeding point, as shown in FIG. 24.

While the passive element is provided in the shape bent on a plurality of positions in the same plane in each of the aforementioned first to third embodiments, the present invention is not restricted to this. According to the present invention, the passive element may alternatively be provided in a shape curved on a plurality of positions in the same plane.

Figure 25:
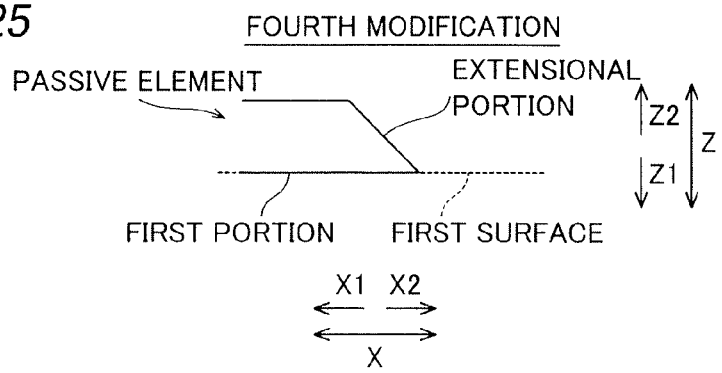
FIG. 25 partially illustrates a passive element of a multiantenna unit of a portable apparatus according to a fourth modification of each of the first to third embodiments of the present invention.

While the extensional portion is formed to extend perpendicularly to the front surface of the substrate as the first surface in each of the aforementioned first to third embodiments, the present invention is not restricted to this. According to the present invention, the extensional portion may not be formed to extend perpendicularly to the first surface, so far as the same is formed to extend in a direction intersecting with the first surface. For example, an extensional portion may be formed to extend in a direction of a prescribed angle other than the right angle with respect to a first surface, as shown in FIG. 25.

Figure 26:
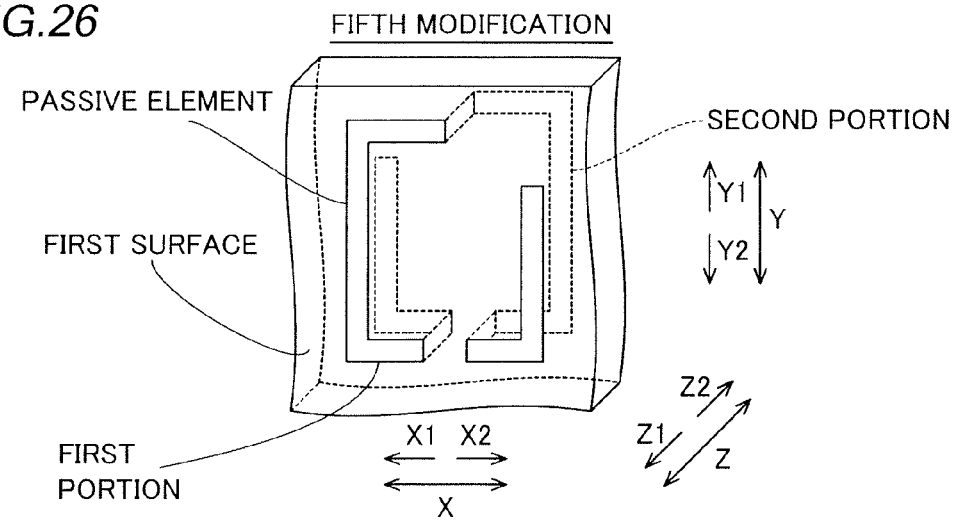
FIG. 26 is a perspective view showing a passive element of a multiantenna unit of a portable apparatus according to a fifth modification of each of the first to third embodiments of the present invention.

While both of the first and second portions are arranged on the front surface of the substrate as the first surface in each of the aforementioned first to third embodiments, the present invention is not restricted to this. According to the present invention, the first portion may simply be arranged on the first surface. For example, a second portion may not be arranged on a first surface, as shown in FIG. 26.

Figure 27:
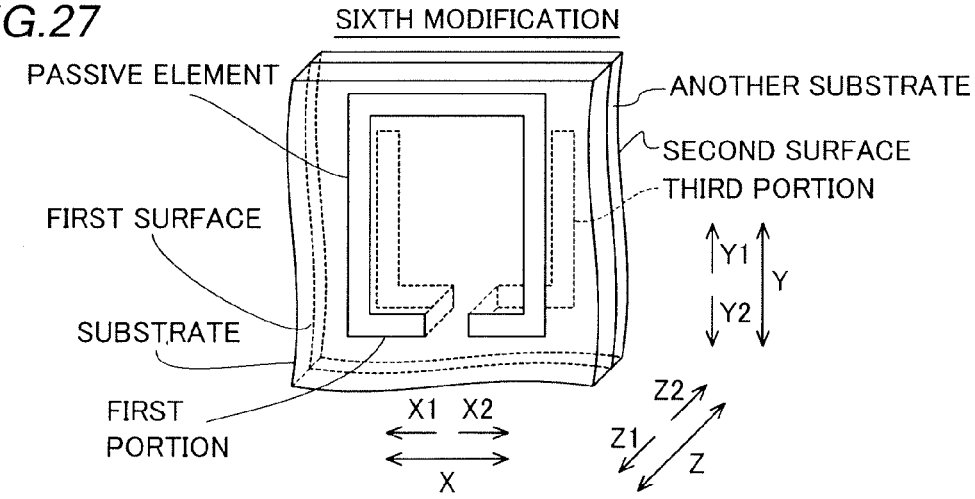
FIG. 27 is a perspective view showing a passive element of a multiantenna unit of a portable apparatus according to a sixth modification of each of the first to third embodiments of the present invention.

While the substrate has both of the front surface as the first surface where the first and second portions are arranged and the back surface as the second surface where the third portion is arranged in each of the aforementioned first to third embodiments, the present invention is not restricted to this. According to the present invention, the substrate may not have the second surface where the third portion is arranged, so far as the same has the first surface where the first portion is arranged. For example, a second surface where a third portion is arranged may alternatively be provided on a substrate different from that having a first surface, as shown in FIG. 27.

While the portable telephone is employed as the example of the communication apparatus including the multiantenna unit in the aforementioned fourth embodiment, the present invention is not restricted to this. The present invention is also applicable to a communication apparatus, such as a PDA (Personal Digital Assistant) or a notebook computer including a multiantenna unit, for example, other than the portable telephone.

While the multiantenna unit for MIMO communication is employed as the example of the multiantenna unit in the aforementioned fourth embodiment, the present invention is not restricted to this. The present invention is also applicable to a multiantenna unit corresponding to a system, such as a diversity system, for example, other than the MIMO system.

While the multiantenna unit is formed to correspond to the WiMAX system in the band of 2.5 GHz in the aforementioned fourth embodiment, the present invention is not restricted to this. According to the present invention, the multiantenna unit may alternatively be formed to correspond to a frequency other than the band of 2.5 GHz, or to correspond to a system, such as a GSM system or a 3G system, other than the WiMAX system, for example.

Figure 33:
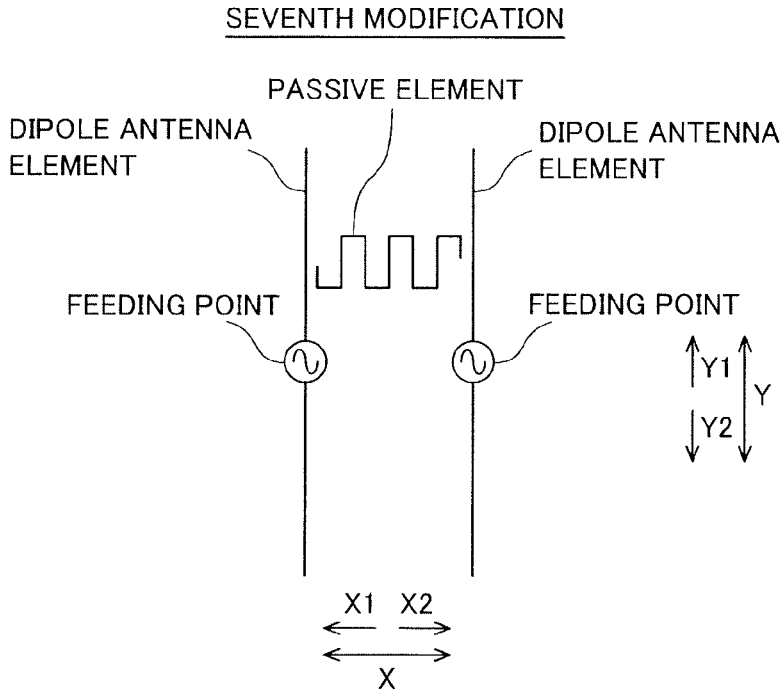
FIG. 33 schematically illustrates a multiantenna unit consisting of dipole antennas according to a seventh modification of the fourth embodiment of the present invention.

While the first antenna element (second antenna element) consisting of the monopole antenna is employed as an example of the first antenna element (second antenna element) in the aforementioned fourth embodiment, the present invention is not restricted to this. According to the present invention, the first antenna element (second antenna element) may alternatively consist of an antenna, such as a dipole antenna, other than the monopole antenna. For example, a non-grounded passive element having a bent or curved shape may be provided between two antenna elements consisting of dipole antennas, as shown in FIG. 33.

While no matching circuits are provided in the aforementioned fourth embodiment, the present invention is not restricted to this. According to the present invention, a first matching circuit 77 (second matching circuit 78) (see FIGS. 34 to 36) for attaining impedance matching at a prescribed frequency corresponding to a multiantenna unit may be provided between a first antenna element (second antenna element) and a first feeding point (second feeding point). According to this structure, intercoupling between antenna elements can be reduced and impedance matching is attained at the prescribed frequency, whereby transmission loss of energy transmitted through the antenna elements can be reduced.

Figure 34:
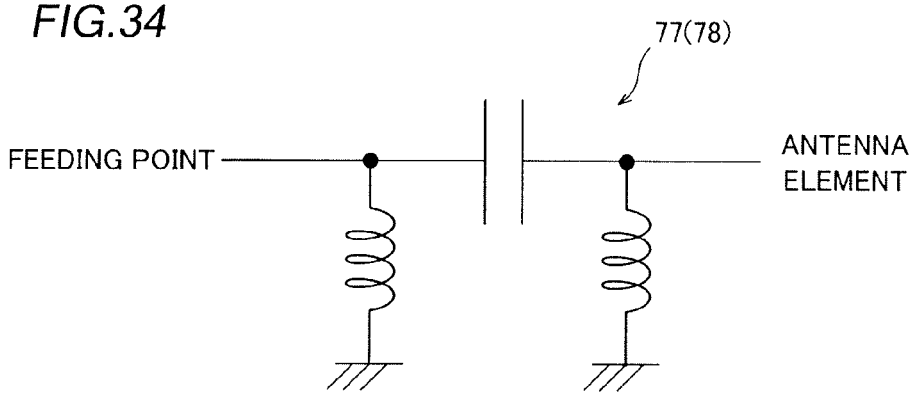
FIG. 34 schematically illustrates a π matching circuit employed for the seventh modification of the fourth embodiment of the present invention.
Figure 35:
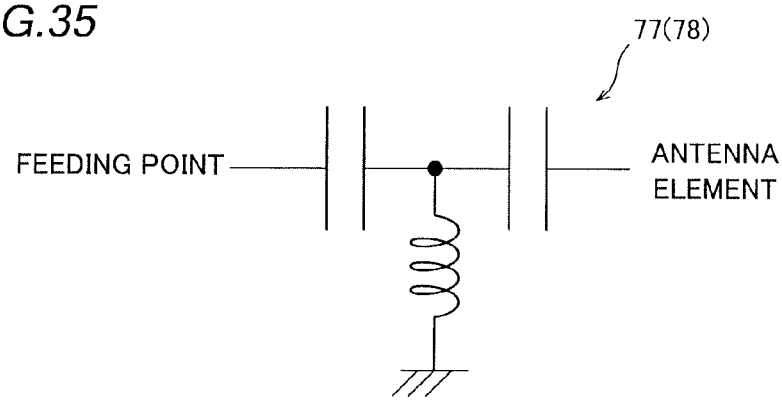
FIG. 35 schematically illustrates a T matching circuit employed for the seventh modification of the fourth embodiment of the present invention.
Figure 36:
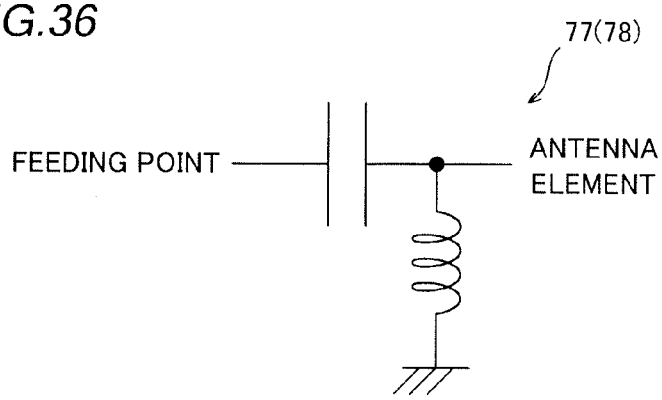
FIG. 36 schematically illustrates an L matching circuit employed for the seventh modification of the fourth embodiment of the present invention.

More specifically, the first matching circuit 77 (second matching circuit 78) is preferably formed by a π circuit (π matching circuit) constituted of inductors (coils) and capacitors as shown in FIG. 34, a T circuit (T matching circuit) constituted of an inductor and a capacitor as shown in FIG. 35, or an L circuit (L matching circuit) constituted of an inductor and a capacitor as shown in FIG. 36, for example. Further, the π circuit, the T circuit or the L circuit may be constituted of only either the inductor(s) or the capacitor(s), or both of the inductor(s) and the capacitor(s).

While the first and second antenna elements are provided in the bent shapes in the aforementioned fourth embodiment, the present invention is not restricted to this. According to the present invention, the first and second antenna elements may alternatively be provided in unbent (or uncurved) linear shapes.

While the connecting portion connecting the first and second coupling portions of the passive element with each other is provided in the bent shape in the aforementioned fourth embodiment, the present invention is not restricted to this. According to the present invention, the first and second coupling portions may alternatively be provided in bent or curved shapes without bending (curving) the connecting portion, or all of the first and second coupling portions and the connecting portion may be provided in bent or curved shapes.

While the connecting portion of the passive element is provided in the bent shape in the aforementioned fourth embodiment, the present invention is not restricted to this. According to the present invention, the connecting portion may alternatively be provided in a curved shape, or in a combinedly bent and curved shape.

While the first and second antenna elements are so arranged that the same are separated from each other at the minimum distance between the end portions (open end portions) along arrow Y1 in the aforementioned fourth embodiment, the present invention is not restricted to this. According to the present invention, the first and second antenna elements may alternatively be so arranged that the same are separated from each other at the minimum distance between the end portions (end portions grounded to the ground plane) along Y2 or between portions other than the end portions.

What is claimed is:

1. A multiantenna unit comprising:

a first antenna element and a second antenna element; and a non-grounded passive element arranged between said first antenna element and said second antenna element, wherein said passive element includes a first portion arranged on a first surface of a substrate and an extensional portion, connected to said first portion, extending in a direction intersecting with said first surface, said passive element further includes a second portion, and said extensional portion includes a first extensional portion connected to said first portion and a second extensional portion connected to said second portion.

2. The multiantenna unit according to claim 1, wherein said first portion includes a first faced portion arranged to face said first antenna element, and said second portion includes a second faced portion arranged to face said second antenna element.

3. The multiantenna unit according to claim 1, wherein said passive element further includes a third portion connected to said extensional portion and arranged on a second surface of said substrate at a prescribed interval from said first surface where said first portion is arranged.

4. The multiantenna unit according to claim 3, further comprising said substrate, on which said first antenna element, said second antenna element and said passive element are arranged, having at least said first surface, wherein said extensional portion is arranged to extend in said direction intersecting with said first surface of said substrate.

5. The multiantenna unit according to claim 4, wherein said substrate has a front surface consisting of said first surface and a back surface consisting of said second surface opposite to said front surface, said first portion and said second portion are arranged on said front surface of said substrate, and said third portion is arranged on said back surface of said substrate.

6. The multiantenna unit according to claim 3, wherein said first portion and said second portion arranged on said first surface are arranged to overlap with said third portion arranged on said second surface in plan view.

7. The multiantenna unit according to claim 2, wherein said first faced portion and said second faced portion of said passive element are arranged at distances allowing electromagnetic field coupling from said first antenna element and said second antenna element respectively.

8. The multiantenna unit according to claim 1, wherein said passive element has an electrical length of substantially half the wavelength of electric waves output from said first antenna element and said second antenna element.

9. The multiantenna unit according to claim 1, further comprising:

a first feeding point feeding high-frequency power to said first antenna element and a second feeding point feeding high-frequency power to said second antenna element, a first matching circuit arranged between said first antenna element and said first feeding point for attaining impedance matching at a prescribed frequency of said high-frequency power, and a second matching circuit arranged between said second antenna element and said second feeding point for attaining impedance matching at a prescribed frequency of said high-frequency power.

10. The multiantenna unit according to claim 1, wherein said passive element is provided in a shape bent or curved on a plurality of positions in the same plane.

11. The multiantenna unit according to claim 1, wherein said first antenna element and said second antenna element include monopole antennas.

12. A communication apparatus comprising a multiantenna unit, wherein said multiantenna unit includes:

a first antenna element and a second antenna element, and a non-grounded passive element arranged between said first antenna element and said second antenna element, and said passive element includes a first portion arranged on a first surface and an extensional portion, connected to said first portion, extending in a direction intersecting with said first surface, said passive element further includes a second portion, and said extensional portion includes a first extensional portion connected to said first portion and a second extensional portion connected to said second portion.

* * * * *